US008761626B2

(12) United States Patent
Seo

(10) Patent No.: US 8,761,626 B2
(45) Date of Patent: Jun. 24, 2014

(54) FIXING APPARATUS AND IMAGE FORMING APPARATUS

(75) Inventor: Hiroshi Seo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 163 days.

(21) Appl. No.: 13/361,379

(22) Filed: Jan. 30, 2012

(65) Prior Publication Data

US 2012/0207502 A1 Aug. 16, 2012

(30) Foreign Application Priority Data

Feb. 15, 2011 (JP) ..... 2011-030112

(51) Int. Cl.
*G03G 15/20* (2006.01)

(52) U.S. Cl.
CPC ..... *G03G 15/20* (2013.01); *G03G 15/2078* (2013.01); *G03G 15/2003* (2013.01); *G03G 15/2082* (2013.01); *G03G 2215/2016* (2013.01); *G03G 2215/2032* (2013.01)
USPC ..... 399/69

(58) Field of Classification Search
CPC ..... G03G 15/20
USPC ..... 399/69, 328, 329
See application file for complete search history.

(56) References Cited

U.S. PATENT DOCUMENTS

| | | | | |
|---|---|---|---|---|
| 7,693,439 | B2 | 4/2010 | Seo et al. | |
| 7,734,208 | B2 | 6/2010 | Seo et al. | |
| 7,742,714 | B2 | 6/2010 | Shinshi et al. | |
| 7,778,581 | B2 | 8/2010 | Seo et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,817,952 | B2 | 10/2010 | Seo et al. | |
| 7,885,590 | B2 | 2/2011 | Seo et al. | |
| 8,014,711 | B2 | 9/2011 | Ito et al. | |
| 8,050,607 | B2 | 11/2011 | Shinshi et al. | |
| 8,457,539 | B2 * | 6/2013 | Nanjo et al. | 399/328 |
| 2005/0205558 | A1 * | 9/2005 | Kinouchi et al. | 219/619 |
| 2005/0207805 | A1 * | 9/2005 | Tsueda et al. | 399/333 |
| 2007/0110466 | A1 * | 5/2007 | Yamaji | 399/69 |
| 2007/0274748 | A1 * | 11/2007 | Yoshikawa | 399/329 |
| 2007/0280754 | A1 | 12/2007 | Ogawa et al. | |

(Continued)

FOREIGN PATENT DOCUMENTS

| | | |
|---|---|---|
| JP | 2975435 | 9/1999 |
| JP | 2001-13805 | 1/2001 |
| JP | 2009-58829 | 3/2009 |
| WO | WO 2006/098275 A1 | 9/2006 |

*Primary Examiner* — Clayton E Laballe
*Assistant Examiner* — Kevin Butler
(74) *Attorney, Agent, or Firm* — Oblon, Spivak, McClelland, Maier & Neustadt, L.L.P.

(57) ABSTRACT

A disclosed fixing apparatus includes a heat generating layer; an exciting coil; a magnetic shunt layer; a degaussing member; and a magnetic flux adjusting unit. A heat generating rotor is configured with at least the heat generating layer, the exciting coil is arranged outside the heat generating rotor and the degaussing member is arranged inside the heat generating rotor. The fixing apparatus is configured to control a temperature of the heat generating layer with a self temperature control function using a Curie temperature of the magnetic shunt layer which is disposed in an opposing location of the exciting coil. A magnetic path forming member which forms a magnetic path of the exciting coil is arranged on the back face side of the degaussing member that is the reverse side of the magnetic shunt layer with the degaussing member inbetween.

11 Claims, 28 Drawing Sheets

(56) References Cited

U.S. PATENT DOCUMENTS

| | | | | |
|---|---|---|---|---|
| 2008/0025773 | A1* | 1/2008 | Ito et al. | 399/333 |
| 2008/0063445 | A1* | 3/2008 | Imai et al. | 399/333 |
| 2009/0028617 | A1* | 1/2009 | Katakabe et al. | 399/333 |
| 2009/0060550 | A1 | 3/2009 | Seo | |
| 2009/0148205 | A1 | 6/2009 | Seo et al. | |
| 2009/0232534 | A1* | 9/2009 | Haseba et al. | 399/69 |
| 2009/0232565 | A1* | 9/2009 | Yasuda et al. | 399/328 |
| 2009/0245897 | A1 | 10/2009 | Seo et al. | |
| 2009/0317157 | A1* | 12/2009 | Murakami | 399/333 |
| 2009/0317158 | A1* | 12/2009 | Murakami et al. | 399/333 |
| 2010/0028061 | A1* | 2/2010 | Nanjo et al. | 399/328 |
| 2010/0247183 | A1* | 9/2010 | Haseba et al. | 399/329 |
| 2010/0272482 | A1* | 10/2010 | Nanjo | 399/328 |
| 2010/0303521 | A1 | 12/2010 | Ogawa et al. | |
| 2010/0322682 | A1* | 12/2010 | Baba | 399/329 |
| 2011/0052277 | A1 | 3/2011 | Ueno et al. | |
| 2011/0052284 | A1* | 3/2011 | Yonekawa | 399/333 |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0091253 | A1 | 4/2011 | Seo et al. | |
| 2011/0150518 | A1 | 6/2011 | Hase et al. | |
| 2011/0222876 | A1 | 9/2011 | Yuasa et al. | |
| 2011/0222926 | A1 | 9/2011 | Ueno et al. | |
| 2011/0229161 | A1 | 9/2011 | Ueno et al. | |
| 2011/0229162 | A1 | 9/2011 | Ogawa et al. | |
| 2011/0229178 | A1 | 9/2011 | Ogawa et al. | |
| 2011/0229236 | A1 | 9/2011 | Ehara et al. | |
| 2011/0311284 | A1 | 12/2011 | Seo et al. | |
| 2012/0014727 | A1* | 1/2012 | Kanou et al. | 399/334 |
| 2012/0177421 | A1* | 7/2012 | Eiki | 399/329 |

* cited by examiner

[ANOTHER EXAMPLE OF DEGAUSSING MEMBER]
LONGITUDINAL DIRECTION OF FIXING ROLLER AXIS
35
50a
16
Δδ
50
300H

LONGITUDINAL DIRECTION OF FIXING ROLLER AXIS
DEGAUSSING FLUX
DEGAUSSING FLUX
DEGAUSSING FLUX
DEGAUSSING CURRENT
35
50a
16
Δδ
50
300H 35
50a
50
300H

[NORMAL USE]
2
2a
3L
300
50
4
16
DEGAUSSING COIL SHORTED (CONDUCTIVE)
HEAT GENERATION SUPPRESSING T>Tc

[HIGH-TEMPERATURE FIXING LAUNCH AND RECOVERY]
2
2a
3L
300
50
4
16
DEGAUSSING COIL OPEN
NO HEAT GENERATION SUPPRESSING (T<Tc)~(NEAR Tc)

NO HEAT GENERATION SUPPRESSING
(NORMAL HEAT GENERATION)
DEGAUSSING COIL OPEN

INDUCTION FLUX FROM MAIN COIL

EDDY CURRENT

DEGAUSSING FLUX OF DEGAUSSING COIL
(CANCEL OUT FLUX OF MAIN COIL)

NO HEAT GENERATION SUPPRESSED
DEGAUSSING COIL OPEN
MAGNETIC SHUNT LAYER
TEMPERATURE T IS
NEAR CURIE TEMPERATURE Tc

→ INDUCTION FLUX FROM MAIN COIL

→ EDDY CURRENT

FIXING APPARATUS AND IMAGE FORMING APPARATUS

CROSS-REFERENCE TO RELATED APPLICATION

The present application is based on and claims priority pursuant to 35 U.S.C. §119 from Japanese Priority Application No. 2011-030112, filed on Feb. 15, 2011, the entire contents of which are hereby incorporated by reference.

TECHNICAL FIELD

The present invention relates to fixing apparatuses and image forming apparatuses using the fixing apparatuses and more specifically relates to using electromagnetic induction heating schemes.

BACKGROUND ART

In image forming apparatuses such as a copying machine unit, a printer unit, a facsimile machine unit, a printing machine unit, a multi-functional unit having functions of previously listed units, etc., visible images such as a toner image, etc., which is borne on a lateral image bearing body are transferred to a sheet-shaped recording medium (below called a sheet) to obtain an image output. The toner image is fixed onto the recording medium with fusion and penetration when it passes through a fixing apparatus. In this way, heating schemes adopted for the fixing apparatus include a thermal roller fixing scheme which is provided with a heating roller such as a halogen lamp, etc., as a heat generating source and a pressurizing roller which opposes and abuts against the heating roller to form a fixing nip portion; a film fixing scheme which uses, as a heating member, a film which requires a smaller heat capacity than a roller itself, etc. Recently, fixing schemes which use electromagnetic induction heating for the heating scheme (see Patent document 1, for example) have been attracting attention.

The electromagnetic induction heating scheme is provided with a configuration such that an induction heating coil wound onto a bobbin inside the heating roller is provided and an electric current is applied to the induction heating coil to generate an eddy current to thereby generate heat in the heating roller, so that preheating such as in the thermal roller fixing scheme which uses the halogen lamp, etc., is not needed, making it possible to raise the heating roller to a predetermined temperature near instantaneously.

Moreover, with respect to the electromagnetic induction heating scheme, a fixing apparatus is known which includes a high frequency induction heating apparatus including an induction heating coil to which a high frequency voltage is applied with a high frequency power supply, and a magnetic heat-generating layer provided at a heating rotor such as the above-described heating roller, wherein a material that has a Curie point which is generally a fixing temperature is used to form the heat generating layer, and the high frequency voltage is applied to the high frequency induction heating apparatus by the high frequency power supply to obtain heat generation necessary for fixing (see Patent document 2, for example).

The apparatus disclosed in Patent document 2 includes an adhesive layer in which a ferromagnetic material is dispersed on a surface of a core bar in the high frequency induction heating apparatus. The adhesive layer instantaneously rises in temperature until the ferromagnetic material contained in the adhesive reaches the Curie temperature, and loses magnetism when the Curie temperature is reached, so that the temperature does not continue to rise, thereby maintaining a constant temperature. The Curie temperature of the above-mentioned ferromagnetic material is generally set at the fixing temperature, so that the ferromagnetic material is generally maintained at the fixing temperature. Therefore, a rise time of a heating rotor may be shortened and highly accurate temperature control may be performed without undermining high releasability, heat resistance, etc., of a surface of the heating rotor that are properties required of a fixing apparatus and also without needing a complex control apparatus.

In such a fixing apparatus which performs self control of an induction heating amount using a magnetic shunt alloy, a scheme is adopted such that a magnetic shunt layer made of the magnetic shunt alloy is disposed between an induction coil and a degaussing member, and when the magnetic shunt alloy reaches the Curie temperature or above, a repulsive magnetic flux due to the degaussing member cancels out an induction magnetic flux to demonstrate a self temperature control function. With reference to portions of Patent document 3 by the present applicant that includes the features which are common to the present invention, one example thereof is generally described as a reference example to clarify the problems.

(Reference Example)

In a fixing apparatus shown in FIG. 12, a fixing roller 3, which opposes and abuts against a pressurizing roller 4, rotates in an arrow direction. In the vicinity of an outer periphery of the fixing roller 3, a magnetic flux generator 2 is fixed to the fixing apparatus body (not shown).

The magnetic flux generator 2 includes a center core 2*c* at a center; an arch core 2*d*, which includes leg cores 2*b*, etc., on both ends; an exciting coil 2*a*, etc. The exciting coil 2*a*, which is disposed between the arch core 2*d* and the fixing roller 3, is a flat coil wound around the center core 2*c* as also shown in FIGS. 13 and 14.

In FIG. 14, an inverter E, which is a drive source, drives the exciting coil 2*a* with a high frequency to generate a high frequency magnetic field (magnetic flux), which causes an eddy current to flow in a fixing sleeve 3H of primarily metal that forms an outer peripheral portion of the fixing roller 3, so as to increase the temperature of the roller 3. A sheet S bearing toner Tn undergoes heating, pressurizing, and fixing when it passes between the fixing sleeve 3H and the pressurizing roller 4 such that a toner face contacts the fixing sleeve 3H.

FIG. 15 shows, in a schematic visual cross-section cut in a radial direction, a portion of the fixing roller 3 that includes, on the innermost side, a degaussing member 5 which also serves as a cored bar, an insulating layer 3B formed of air (or foam), a magnetic shunt layer 3C, an antioxidant layer 3D1, a heat generating layer 3E, an antioxidant layer 3D2, an elastic layer 3F, and a releasing layer 3G. The magnetic shunt layer 3C, the antioxidant layer 3D1, the heat generating layer 3E, the antioxidant layer 3D2, the elastic layer 3F, the releasing layer 3G, etc., make up the fixing sleeve 3H, which is an integral heat generating rotor.

The degaussing member 5 in FIG. 15 is made of aluminum or an aluminum alloy, while the insulating layer 3B formed of air is a gap of about 5 mm, for example. The magnetic shunt layer 3C is made of an appropriate magnetic shunt alloy having a thickness of 50 μm, for example. The antioxidant layers 3D1 and 3D2 are nickel strike plated and have a thickness of less than or equal to 1 μm, for example. The heat generating layer 3E is Cu plated and has a thickness of 15 μm, for example. The elastic layer 3F is made of a silicone rubber and has a thickness of 150 μm, for example. The releasing layer 3G is made of PFA having a thickness of 30 μm, for example. A thickness from the magnetic shunt layer 3C to the surface of the releasing layer 3G is approximately 200-250 μm, for example.

The magnetic shunt layer 3C includes a magnetic material (e.g., a magnetic shunt alloy material including iron and nickel) which is formed such that the Curie temperature falls in a range of 100-300° C., for example, and is always disposed between the exciting coil 2A and the degaussing member 5. The magnetic shunt layer 3C prevents the heat-generating layer 3E, etc., from being overheated. The degaussing member 5 is a cylindrically shaped roller and has a circular shape concentric with the fixing sleeve 3H.

With reference to FIGS. 16A and 16B, a heat generation preventing function by the degaussing member 5 in "a self temperature control-type fixing apparatus using a magnetic shunt alloy" is described.

(1) FIG. 16A shows a non-functioning state, which is without the heat generation preventing function, as the magnetic shunt layer 3C is at a temperature lower than the Curie temperature. As shown, a temperature T of the magnetic shunt alloy which makes up the magnetic shunt layer 3C is lower than a Curie temperature Tc (T<Tc). A bold solid line arrow shows induction magnetic flux from the exciting coil 2*a*, while a thin solid line arrow shows an eddy current flowing in the magnetic shunt alloy. As the temperature T of the magnetic shunt alloy is lower than the Curie temperature, the magnetic shunt alloy within the fixing sleeve 3H remains as a magnetic material, and the induction magnetic flux which the exciting coil 2*a* generates does not penetrate through the magnetic shunt layer 3*c*.

As the magnetic shunt alloy has magnetism at the above-described temperature of lower than the Curie temperature, it does not pass through the induction magnetic flux from the exciting coil 2*a* in an arrangement such that the magnetic shunt alloy is disposed between the exciting coil 2*a* and the degaussing member 5, so that the induction magnetic flux does not reach the degaussing member 5, and a repulsive magnetic field is not generated in the degaussing member 5, so that there is no suppressing of heat generation by the magnetic shunt alloy. Therefore, the heat generating layer 3E generates heat due to the induction magnetic flux of the exciting coil 2*a*, which heat is transferred to and sensed by the magnetic shunt layer 3C, making it possible to rapidly increase its temperature to a temperature near the Curie temperature.

(2) FIG. 16B shows a functioning state, which is with the heat generation preventing function, as the magnetic shunt layer 3C is at a temperature exceeding the Curie temperature. As shown, the temperature T of the magnetic shunt layer 3C exceeds the Curie temperature Tc and loses magnetism, so that, in an arrangement such that the magnetic shunt alloy is disposed between the exciting coil 2*a* and the degaussing member 5, the induction magnetic flux (shown in a bold line) from the exciting coil 2*a* penetrates through the magnetic shunt layer 3C and the insulating layer 3B to reach the degaussing member 5. Thus, the induction magnetic flux from the exciting coil 2*a* passes through the degaussing member 5. When the time-varying induction magnetic flux penetrates the degaussing member 5 (conductor), an induction current (an eddy current shown as a thin solid line) flows in the degaussing member 5, the induced eddy current acts toward canceling out the induction magnetic flux, and, in conjunction therewith, a repulsive magnetic flux (shown in a dotted line) which cancels out the induction magnetic flux is induced. The repulsive magnetic flux cancels out the induction magnetic flux from the exciting coil 2*a*, so that heat generating efficiency of the heat generating layer 3E due to the induction magnetic flux from the exciting coil 2*a* decreases.

As shown in FIG. 16A, the magnetic shunt layer 3C, which is a magnetic body and which includes a heat generating layer, almost instantaneously rises in temperature until it reaches the Curie temperature. However, as shown in FIG. 16B, when the Curie temperature is reached (i.e., when T>Tc), magnetism is lost, so that a temperature rise due to induction heating does not occur, maintaining a constant temperature. Thus, this is a self temperature control function which utilizes the Curie temperature by mutual interaction of the exciting coil 2*a*, the degaussing member (cored bar) 5, the magnetic shunt layer 3C, and the heat generating layer 3E.

Therefore, when the magnetic shunt alloy 3C is arranged such that the Curie temperature of a material which makes up the magnetic shunt alloy 3C falls in a range of 100-300° C., which is a range of temperature used in this type of fixing apparatus, the degaussing member 5 and the heat generating layer 3E of the fixing sleeve 3 may not overheat, so that a fixing temperature may generally be maintained, without undermining high releasability and heat resistance at the surface of the fixing sleeve 3H and without needing complex control.

(Problems with the Above-Described Reference Example)

FIG. 17 is a diagram showing temperature dependence of permeability (heat generation efficiency) of the magnetic shunt layer 3C. As shown, Δ denotes the permeability at the respective temperatures. In the fixing apparatus of the present example, a self temperature control function acts, so that it is easy to perform temperature control at a setting temperature near 180° C. (a fixing temperature which is set near the Curie temperature). However, as seen from FIGS. 16A and 16B, the permeability is very high at less than the setting temperature (a fixing temperature which is set near the Curie temperature), but drastically decreases beyond the setting temperature. Therefore, as the magnetic shunt layer 3C greatly falls in permeability near the Curie temperature, magnetic flux penetrates through the degaussing member 5, and the self temperature control function is demonstrated due to a repulsive magnetic flux from the degaussing member 5, so that it is difficult to heat the apparatus to a temperature which is higher than or equal to the Curie temperature.

In this way, in a self temperature control type fixing apparatus which uses a magnetic shunt alloy, there is a problem that it is not possible to rapidly perform warming up since heat generating efficiency decreases as the temperature of the heat generating body approaches the Curie temperature. As a countermeasure, it is possible to increase the Curie temperature of the magnetic shunt alloy such that heating to a high temperature can be performed. However, in this case, as an upper-limit temperature for a temperature of an end portion at the time of paper passing rises, a problem occurs that a difference in luster becomes large between a small-sized paper passing section and non-paper passing section as shown in FIG. 18, for a large-sized (for example, an A3 paper) image immediately after consecutive small-sized papers passing, etc.

Thus, as related art, in Patent document 3 is proposed, as in the following, a fixing apparatus which heats with an exciting magnetic flux from an induction coil, wherein a magnetic shunt alloy layer is disposed between the induction coil and a degaussing member, and which enables control in a manner such that, when a self temperature control property is to be demonstrated, the degaussing member demonstrates a degaussing function to generate a magnetic flux repulsing an induction magnetic flux, and, when a self temperature control function is not demonstrated, the degaussing member does not demonstrate the degaussing function, and, at the timing of warming up, the self temperature control function is not demonstrated, so that a high speed launching is implemented.

FIGS. 19A and 19B show configurations and operating states of the magnetic flux generator 2 and a fixing roller 30 where the configuration of the magnetic flux generator is the same as the above-described FIGS. 12 and 13. For the fixing roller 30, the fixing sleeve 3H has the same basic structure as that shown in FIG. 15. The feature of the fixing roller 30 of the present example differs from the feature of the fixing roller 3 in that, as the degaussing member 5 shown in FIGS. 12 and 15, a pair of degaussing coils 3L as a degaussing member is provided inside the fixing sleeve 3H which includes the magnetic shunt layer 3C. The degaussing coil 3L is supported such that it holds an arrangement which opposes the exciting coil 2*a* with the fixing sleeve 3H inbetween.

In FIG. 20 is shown the manner in which the degaussing coil 3L is supported. Side plates 8L and 8R of the fixing apparatus support the magnetic flux generator 2 and support the fixing roller 30 via bearings. The fixing sleeve 3H is a heat generating rotor which forms an outer peripheral portion of the fixing roller and is fixed to flanges 7R and 7L. An internal member 66, which is disposed inside (on the inner side) of the fixing sleeve 3H and which immovably supports the degaussing coil 3L, etc., so as to be non-rotating relative to the rotating fixing sleeve, has its right axle 6R supported by the flange 7R via a bearing 6. An axle 9R of the flange 7R that penetrates the side plate 8R is supported via a bearing and connected to a rotational drive source (not shown). A left axle 6L of the internal member 66 is supported by the flange 7L via the bearing 6 and penetrates the flange 7L to protrude toward outside, and an axle 9L of the left flange 7L is fixed to the left side plate 8L of the fixing apparatus. In this way, the fixing sleeve 3H is arranged to rotate between the stationary degaussing coils 3L, 3L and the stationary magnetic flux generator 2.

With reference to FIG. 21, a switching element 16 is turned on to short the degaussing coil 3L (to make the degaussing coil 3L conductive), or is turned off to make the degaussing coil 3L non-degaussing, so that it has a switching function which is designed to suppress the induction magnetic flux by the exciting coil 2*a*. While a relay switch, a semiconductor switch, a variable resistive element, etc., may be used as the switching element 16, other means may be used. Moreover, the degaussing coil 3L is not provided with a drive source. Moreover, as shown in FIGS. 19A and 19B, relative to the exciting coil 2*a* which is divided into two halves with a center core 2*c* inbetween, one degaussing coil 3L is arranged for each side on the axial longitudinal direction with an air gap at a center portion on the axial longitudinal direction of the fixing roller relative to the exciting coil 2*a*. Preferably, multiple degaussing coils 3L, about 3, for example, may be provided. In the present invention, one or more of the degaussing coils 3L may be provided, so that, there is no limit to the number. Then, control is performed according to a rate of switching by the switching element 16 per unit time.

(Degaussing Coil in Conducting State: with Heat Generation Suppressing Function)

FIG. 19A illustrates a cross section of the fixing sleeve 30, showing an operation state for enhancing the degaussing function. The fixing sleeve 3H which includes the magnetic shunt layer 3C is disposed between the exciting coil 2*a* and the degaussing coil 3L. Moreover, the degaussing coil 3L as an example of a degaussing member is arranged at a position such that the induction magnetic flux (solid line) of the exciting coil 2*a* passes through the magnetic shunt layer 3*c* to reach the degaussing coil 3L.

At T>Tc, the switching element 16 is turned on to short the degaussing coil 3L (to make the degaussing coil 3L conductive). In this way, a current is induced in the degaussing coil 3L in a direction for canceling out the induction magnetic flux from the exciting coil 2*a*, causing a repulsive magnetic flux (degaussing magnetic flux) shown with a broken line arrow to be generated to cancel out and weaken the induction magnetic flux from the exciting coil 2*a*. The switching element 16 is switched on to suppress heat generation of the heat generating layer 3E.

When the magnetic shunt layer 3C is at a temperature which is higher than or equal to the Curie temperature, the induction magnetic flux (solid line) from the exciting coil 2*a* may pass through. When the temperature of the magnetic shunt layer 3 is near the Curie temperature or at a temperature which is higher than but close to the Curie temperature, as the repulsive magnetic flux from the degaussing coil 3L increases, the induction magnetic flux due to the exciting coil 2*a* decreases, so that an eddy current due to the induction magnetic flux at the heat generating layer 3E and the amount of heat generated decreases.

When the amount of heat generated decreases, the temperature of the magnetic shunt layer 3C decreases to the Curie temperature and in conjunction the magnetic flux which passes through the magnetic shunt layer 3C decreases and the repulsive magnetic flux decreases. However, the induction magnetic flux which passes through the heat generating layer 3*e* increases in correspondence with the decreased repulsive magnetic flux, so that an amount of heat generated increases. In this way, the amount of heat generated at the heat generating layer 3E is automatically controlled such that the magnetic shunt layer 3C reaches a temperature near the Curie temperature. The above-described state corresponds to a characteristic line which connects the Δ symbols at a setting temperature of 200° C. or higher in FIG. 22.

Here, as shown in FIG. 19A, assuming a degaussing member functioning state (an ON state of the switching element 16), the induction magnetic flux of the exciting coil 2*a* cannot pass through the magnetic shunt layer 3C, so that the repulsive magnetic flux due to the degaussing coil 3L is not generated. Thus, the induction magnetic flux due to the exciting coil 2*a* makes it possible to generate an eddy current at the heat generating layer 3E without any constraint and to cause heat to be generated in the heat generating layer 3E as much as possible. The above-described state corresponds to a characteristic line (maximum amount of heat generated of 1000 W) which connects the Δ symbols at the setting temperature of 180° C. or below in FIG. 22.

(Degaussing Coil in Non-Conducting State: without Heat Generation Suppressing Function)

On the other hand, FIG. 19B is a cross-sectional diagram of the fixing roller 30 that shows an operation state in which the degaussing function is not demonstrated. The switching element 16 is turned off to block the degaussing coil 3L and cause the degaussing magnetic flux to not be generated, so that the degaussing function is not demonstrated.

The degaussing coil 3L is disposed away from and on the opposing side of the exciting coil 2*a* with the fixing sleeve 3H inbetween. When the temperature T of the magnetic shunt alloy is higher than the Curie temperature Tc, the induction magnetic flux from the exciting coil 2*a* penetrates through the magnetic shunt layer 3C, but the degaussing coil 3L is blocked, so that the induction repulsive magnetic flux is not generated. Thus, the induction magnetic flux (solid line) generates an eddy current in the heat generating layer 3E without constraint and causes heat to be generated in the heat generating layer 3E. The above-described state corresponds to a characteristic line (maximum heat value of 1000 W) which connects the ○ symbols at the setting temperature of 180° C. or higher in FIG. 22.

Assuming a non-degaussing functioning state in which the degaussing coil 3L of FIG. 19B has the switching element 16 turned off, even in this case, in the heat generating layer, an eddy current is generated without constraint, causing heat to be generated. The above-described state, which corresponds to a characteristic line (maximum heat value of 1000 W) which connects the ○ symbols at the setting temperature of 180° C. or less in FIG. 22, makes it possible to perform heat generation of the heat generating layer as much as possible.

In this way, the switching element 16 constitutes one example of a magnetic flux adjusting unit in that the switching element 16 acts on the degaussing coil 3L in operation modes of on and off in which a circuit which includes the degaussing coil 3L is turned on and off to adjust the repulsive magnetic flux.

While omitted in FIGS. 19A and 19B for convenience of explanations, in practice, as shown in FIGS. 23A and 23B, a nip member 55 which is pressurized by a pressurizing roller 4 is immovably provided at a portion which is inside the fixing sleeve 3H and which opposes the pressurizing roller 4 and is supported by the immovable internal member 66. Here, immovable means immovable relative to the rotating fixing sleeve 3H.

Here, what may be a problem is that there is the internal member 66. As shown in FIGS. 23A and 23B, the internal member 66 immovably supports the nip member 55 inside the rotating fixing sleeve 30. Moreover, the internal member 66 may support the degaussing coil 3L which similarly needs to be immovably supported as well as other members which need to be immovably supported.

FIG. 23A, which corresponds to FIG. 19B, additionally includes the internal member 66 and the nip member 55 therein in order to describe the impact of the internal member 66 when the switching element 16 is off. In FIG. 23A, where $T<Tc$, the temperature T of the magnetic shunt layer 3C which is included in the fixing sleeve 3H is lower than the Curie temperature, so that, when the degaussing coil 3L is turned off and in the non-degaussing functioning state, the induction magnetic flux due to the exciting coil 2*a* may not pass through the magnetic shunt layer 3C, so that the repulsive magnetic flux due to the degaussing coil 3L is not generated. Thus, the induction magnetic flux due to the exciting coil 2*a* makes it possible to generate an eddy current in the heat generating layer 3E without any constraint, there is no heat generation suppressing, leading to a normal heat generating state, so that there is no particular problem.

However, when the temperature T of the magnetic shunt alloy which forms the magnetic shunt layer 3C under the condition in FIG. 23A rises to a temperature near the Curie temperature, the induction magnetic flux due to the exciting coil 2*a* passes through the magnetic shunt layer 3C as shown in FIG. 23B. However, the switching element 16 is in an off state, so that the repulsive magnetic flux by the degaussing coil 3L is not generated, but the induction magnetic flux due to the exciting coil 2*a* penetrates through the degaussing coil 3L, so there is a problem that the magnetic flux, which has penetrated through the degaussing coil 3L, is induced by the internal member 66 which includes an induction heating body which supports the degaussing coil 31, the nip member 55, etc., so that an eddy current is generated, causing a heat generating loss 80 to be generated.

Patent Documents

Patent document 1: JP2001-13805A
Patent document 2: JP2975435B
Patent document 3: JP2009-058829A

DISCLOSURE OF THE INVENTION

In light of the problems as described above, the present invention aims to provide a fixing apparatus and an image forming apparatus which prevents magnetic flux, due to an exciting coil, penetrating through a degaussing coil and the magnetic flux which has penetrated through the degaussing coil being induced by an internal member arranged within a heat generating rotor to generate an eddy current and to cause a heat generation loss to occur.

According to an embodiment of the present invention, a fixing apparatus is provided, including a heat generating layer; an exciting coil which generates magnetic flux and which inductively heats the heat generating layer with the magnetic flux; a magnetic shunt layer which senses temperature with heat generated in the heat generating layer; a degaussing member which cancels out an induction magnetic flux from the exciting coil with a repulsive magnetic flux; and a magnetic flux adjusting unit which acts on the degaussing member to adjust the repulsive magnetic flux, wherein a heat generating rotor is configured with at least the heat generating layer, the exciting coil is arranged outside the heat generating rotor and the degaussing member is arranged inside the heat generating rotor, the fixing apparatus being configured to control a temperature of the heat generating layer with a self temperature control function using a Curie temperature of the magnetic shunt layer which is disposed in an opposing location of the exciting coil, wherein a magnetic path forming member which forms a magnetic path of the exciting coil is arranged on the back face side of the degaussing member that is the reverse side of the magnetic shunt layer with the degaussing member therebetween.

According to the embodiment of the present invention, in a fixing apparatus which sets a degaussing function to be controllable to make it possible to adjust a self temperature control function, to set a temperature to an arbitrarily high temperature even when a magnetic shunt layer is being used, and to implement a suppression of a rapid warming up and a temperature overshoot, so that a heat generating loss which occurs in an internal member due to magnetic flux which penetrates through a related-art degaussing member may be reduced.

BRIEF DESCRIPTION OF THE DRAWINGS

Other objects, features, and advantages of the present invention will become more apparent from the following detailed descriptions when read in conjunction with the accompanying drawings, in which:

FIG. 8A shows an example which uses a plate-shaped member as a degaussing member in a mode without heat generation suppressing with a switching element being turned off;

FIG. 8B shows an example which uses the plate-shaped member as the degaussing member in a mode with the heat generation suppressing with the switching element being turned on;

FIG. 8C shows an example which uses the plate-shaped member as the degaussing member with a cross section having the degaussing member cut in a direction which is perpendicular to the longitudinal direction;

BEST MODE FOR CARRYING OUT THE INVENTION

Embodiment 1

Configuration and Operation of Image Forming Apparatus

Figure 1:
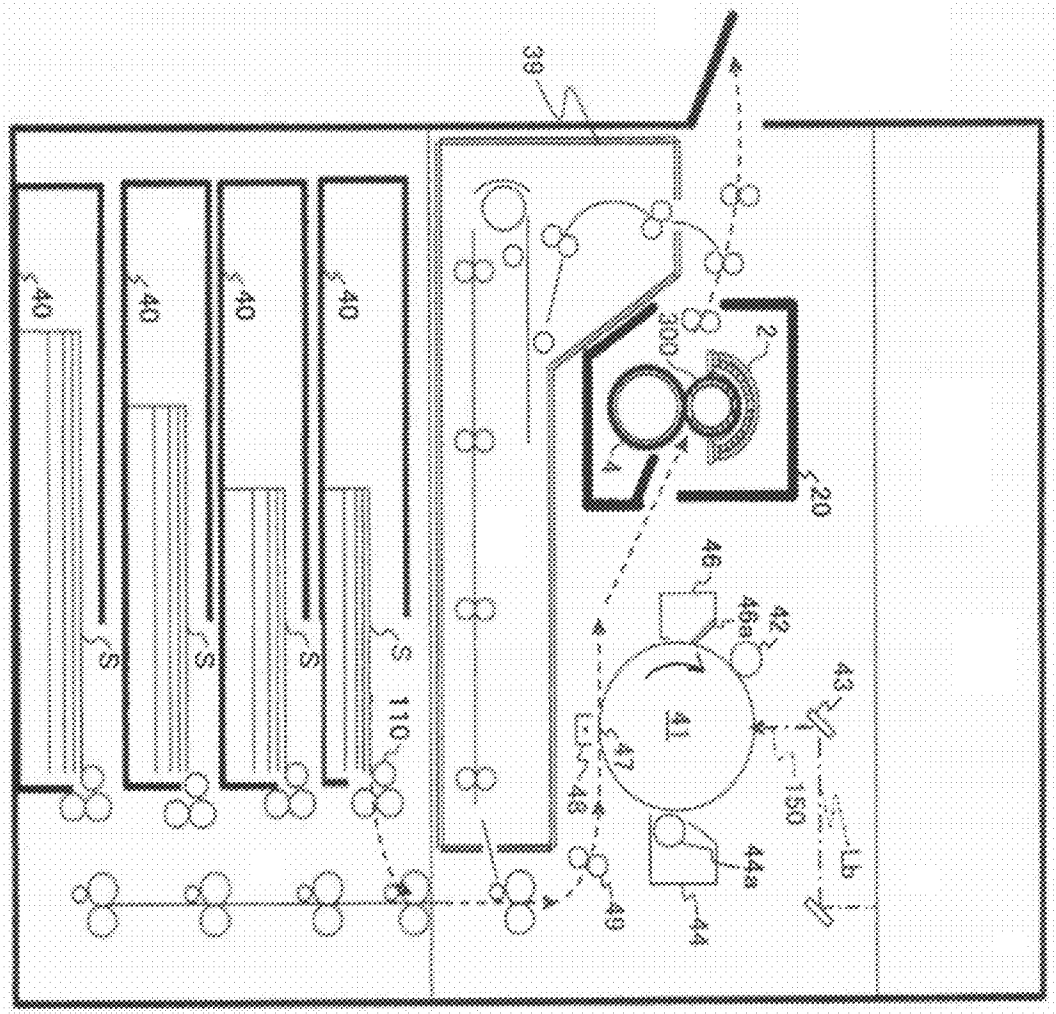
FIG. 1 is a diagram illustrating one example of an image forming apparatus to which a fixing apparatus according to an embodiment of the present invention is applied.

FIG. 1 is a diagram illustrating one embodiment of an image forming apparatus to which a fixing apparatus according to the present embodiment is applied. As a matter of course, the present invention is not limited to the image forming apparatus of the type shown in FIG. 1, so that it is applicable to not only the image forming apparatus which creates a monochrome image, but also to the image forming apparatus which forms a color image.

The image forming apparatus shown includes an electrophotographic photosensitive body (called merely a photosensitive body below) 41, around which photosensitive body 41 are successively provided in a direction of rotation that is shown with an arrow, a charging apparatus 42 which includes a charging roller; and a mirror 43 which makes up a part of an exposing unit. Moreover, it also includes a developing roller 44*a*; a transfer apparatus 48 which transfers an image (a toner image) which is developed on the photosensitive body 41; a cleaning unit 46 which is provided with a blade 46*a* which slidingly contacts a peripheral face of the photosensitive body 41, etc. Then, an exposing light Lb for latent image forming is arranged to irradiate and scan via the mirror 43 a position between the charging apparatus 42 and the developing roller 44*a* on the photosensitive body 41. The irradiating position of the exposing light Lb is called an exposing portion 150.

A portion at which the transfer apparatus 48 opposes a lower face of the photosensitive body 41 is a known transfer section 47 at which a toner image is transferred to a sheet S and a pair of registration rollers 49 is provided on the upstream side in a paper-supply direction relative to the transfer section 47. The sheet S, which is stored in any paper-supply tray 40 out of multiple paper-supply trays 40, is sent out by a roller of a group of paper-supply rollers 110 and conveyed while it is guided by a conveying guide and a conveying roller group (not shown with a number).

Moreover, a fixing apparatus 20 is arranged at a position downstream of the transfer section 47 in a paper-supply direction. On the downstream side of the fixing apparatus in the paper-supply direction, an automatic double side apparatus 39 which, at the time of double side recording, turns over the front and the back of a transfer sheet, places a recorded sheet face in a downward direction to again supply the sheet to the transfer section 47, so that images on both sides can be formed by a mode change.

Image forming at the image forming apparatus is generally performed as follows. First, on the upper side of the apparatus, the photosensitive body 41 starts rotation, during which rotation the photosensitive body 41 is uniformly charged by the charging apparatus 42 in the dark, and the exposing light Lb, which corresponds to an image to be created irradiates and scans the exposing portion 150, so that a latent image corresponding to an image to be created is formed on the photosensitive body 41. When the latent image approaches a developing apparatus 44 by rotation of the photosensitive body 41, it is turned into a visible image (a manifest image) by toner, so that it becomes a toner image borne on the photosensitive body 41.

On the other hand, on the lower side of the apparatus, the sheet S is selected by the group of paper-supply rollers 110 of the corresponding paper-supply tray 40 of the multiple paper-supply trays 40, so that, for example, it is conveyed to a position of the pair of registration rollers 49 via a predetermined conveying path which is shown in a broken line in FIG. 1, for example, then it is stopped, and sent out in a timing such that the toner image on the photosensitive body 41 opposes a predetermined position of the sheet S at the transfer portion 47. In other words, at a suitable timing, sending out from the registration roller 49 of the sheet S that had been stopped at the position of the registration roller 49 is started, so that the sheet S is conveyed toward the transfer portion 47.

A position of the toner image on the photosensitive body 41 matches, at the transfer portion 47, a predetermined position of the sheet S to which the toner image is to be transferred, so that the toner image is attracted and transferred onto the sheet S due to an electric field by the transfer member 48. In this way, the sheet S which is bearing the toner image by transferring at the image forming portion around the photo sensitive body 41 is sent out to the fixing apparatus 20. The toner image on the sheet S is heated and pressurized during the time in which it passes the fixing apparatus 20, so that it is fixed to the sheet S, after which it is discharged.

Moreover, when image forming is performed on both sides of the sheet S, the front and back of the sheet S, which is output to the automatic double side apparatus 39 by a branching pawl (not shown), are reversed with a switchback scheme by the automatic double side apparatus 39, and the sheet S is conveyed to a conveying path before the registration roller 49.

Remaining toner which has remained on the photosensitive body 41 without being transferred at the transfer portion 47 reaches the cleaning unit 46 with rotation of the photosensitive body 41, is cleaned off and removed from an upper part of the photosensitive body 41 during the time in which it passes through the cleaning apparatus 46, making it possible to transfer to the next image forming process.

For the fixing apparatus 20, an apparatus that uses a heat generating rotor of the below-described various types may be applied. For example, adopting a fixing scheme which adopts a pair of rollers is also an example. At any rate, the fixing apparatus is provided with a heat generating rotor for heating the sheet S to be fixed to.

Embodiment 2

Configuration and Operation of Fixing Apparatus

Embodiment 2-1

Figure 2:
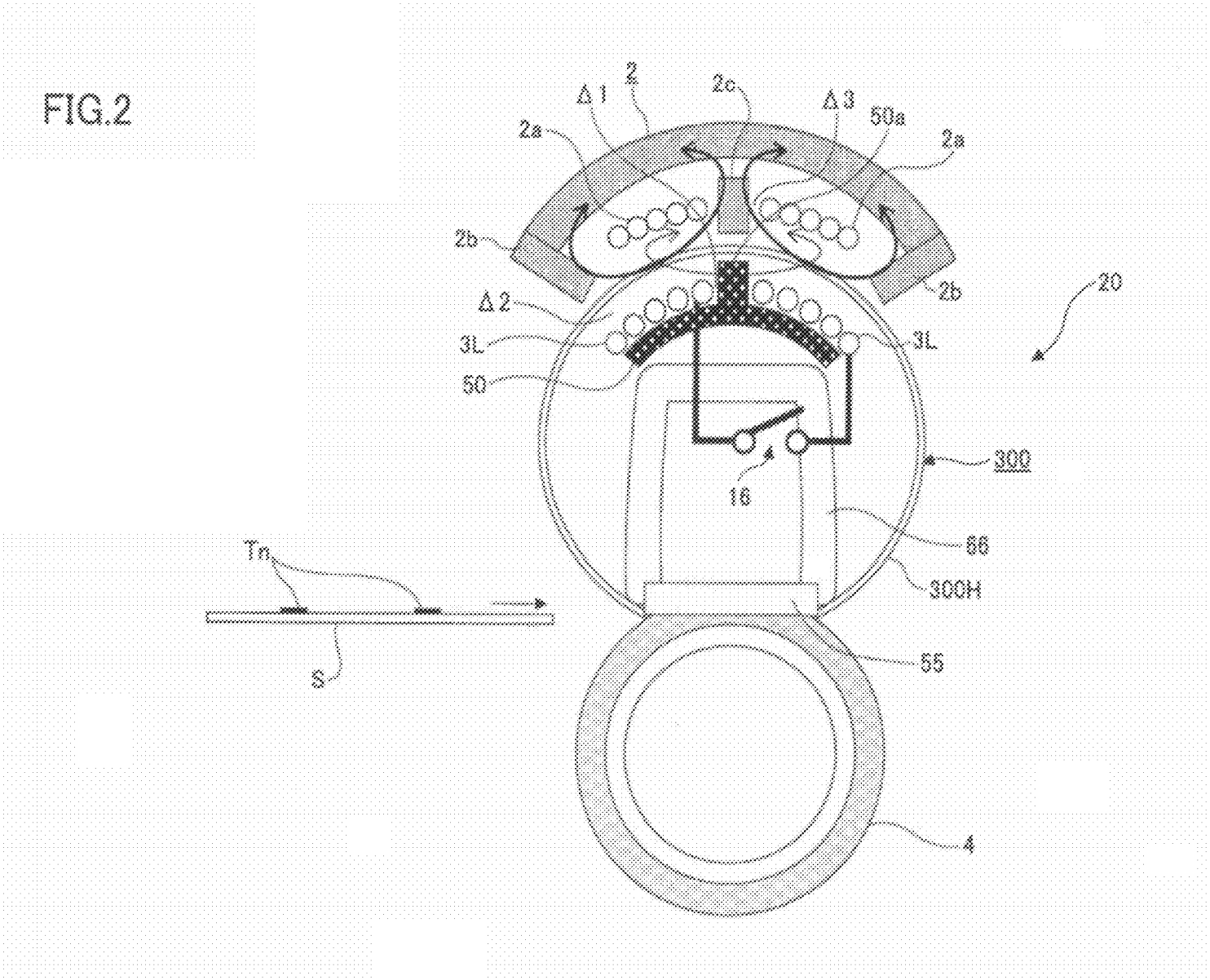
FIG. 2 is a diagram illustrating a configuration of a main part of the fixing apparatus according to an embodiment of the present invention.
Figure 23A:
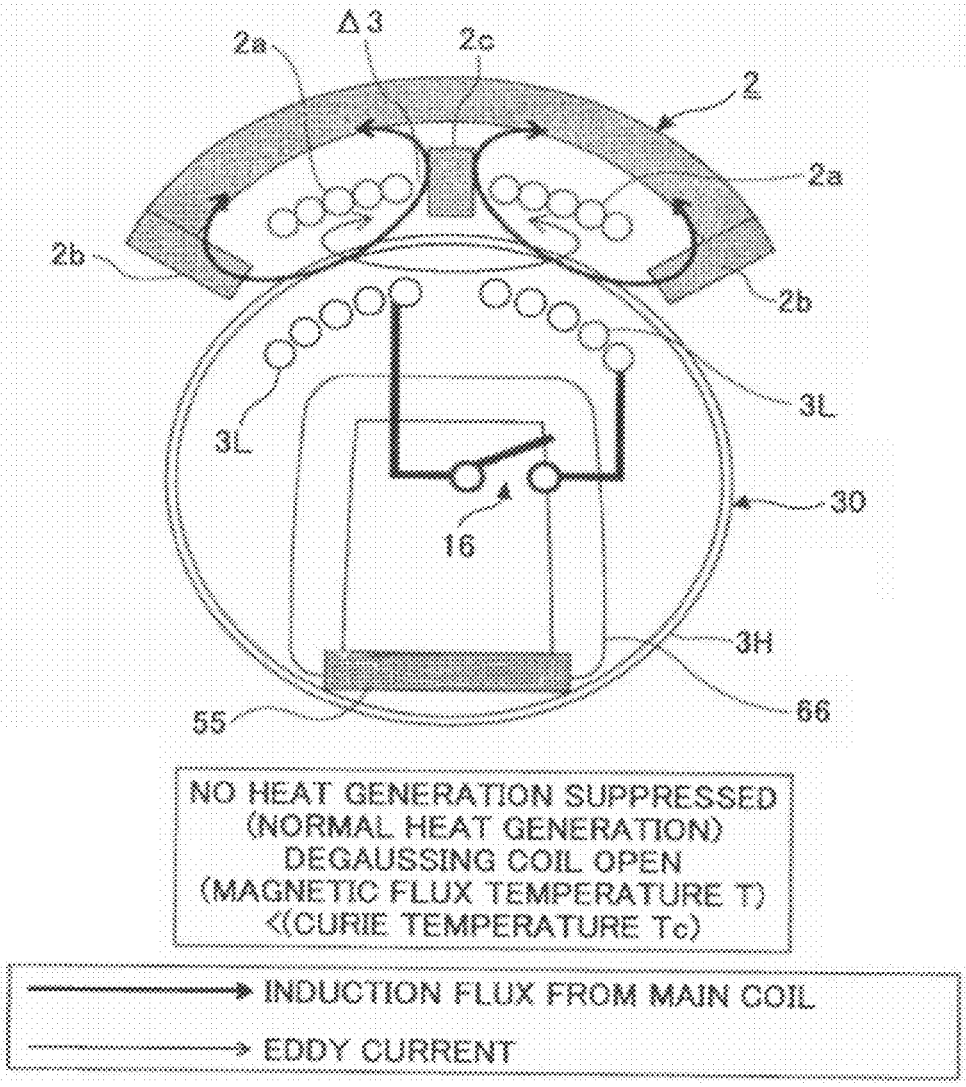
FIG. 23A is a diagram which corresponds to FIG. 19B and which assumes a case of $T<Tc$ with an impact of an internal member in a switch open state being additionally included in order to take into account the impact.

Embodiment Such that a Heat Generating Rotor is a Fixing Sleeve which Includes at Least a Heat Generation Layer and a Magnetic Shunt Layer FIG. 2 is a cross-sectional diagram illustrating a conceptual configuration of a roller-type fixing apparatus 20 which may be used for the image forming apparatus shown in FIG. 1. FIG. 2 shows, as the fixing apparatus 20, a fixing roller 300; a magnetic flux generator 2; and a pressurizing roller 4 which is pressed by the fixing roller 300. Compared with the fixing roller in FIGS. 23A and 23B that is described in the related art section, the present configuration includes the feature that a magnetic path forming member 50 is provided within a fixing sleeve 300H which makes up the fixing roller 300. The fixing sleeve 300H, which is a heat generating rotor, has a relationship with the pressurizing roller 4 such that it opposes and abuts with the pressurizing roller 4 to form a fixing nip, so that it rotates in an arrowed direction.

Figure 12:
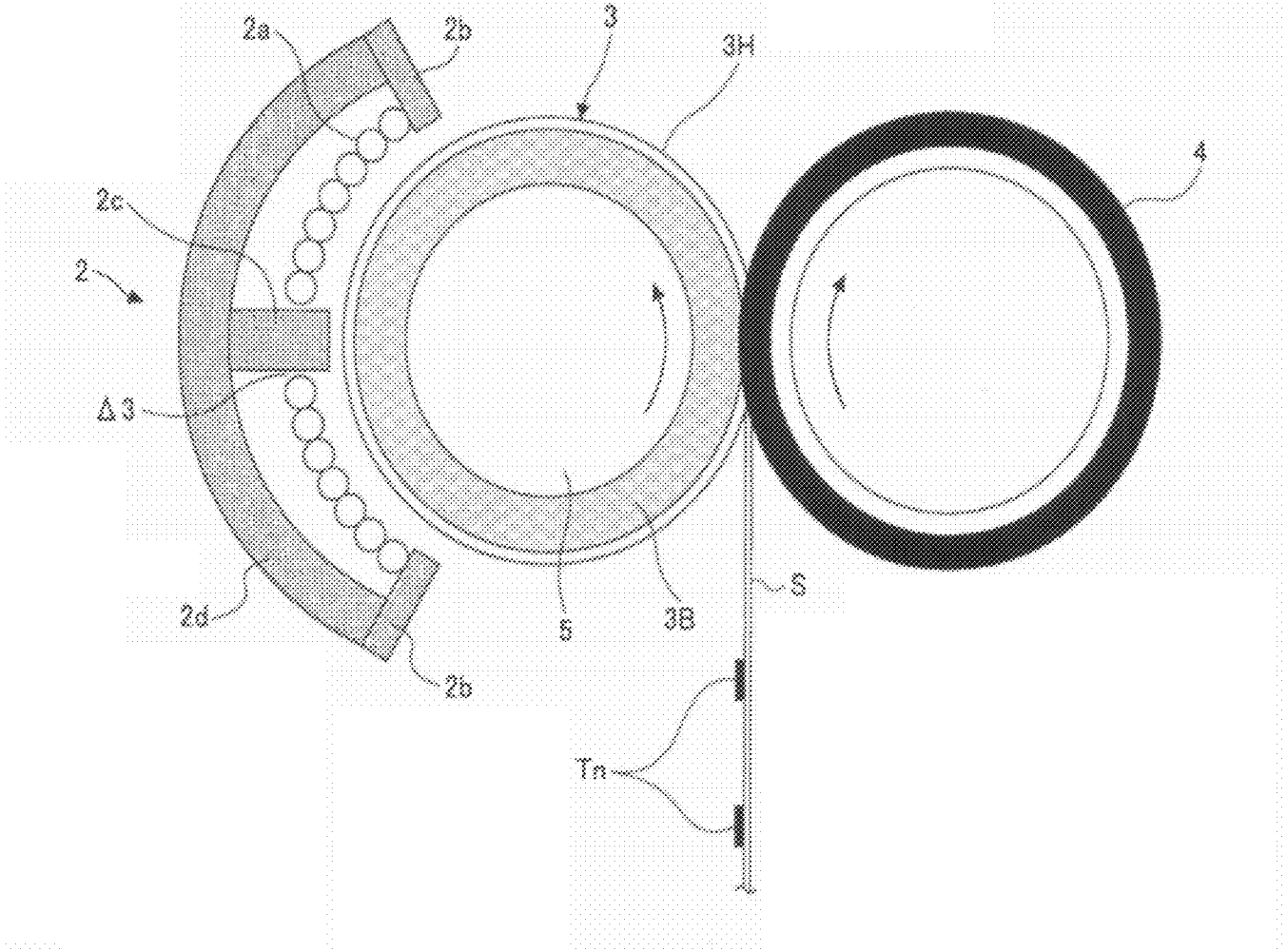
FIG. 12 is a diagram illustrating one example of a roller-type fixing apparatus which is used for the image forming apparatus.
Figure 13:
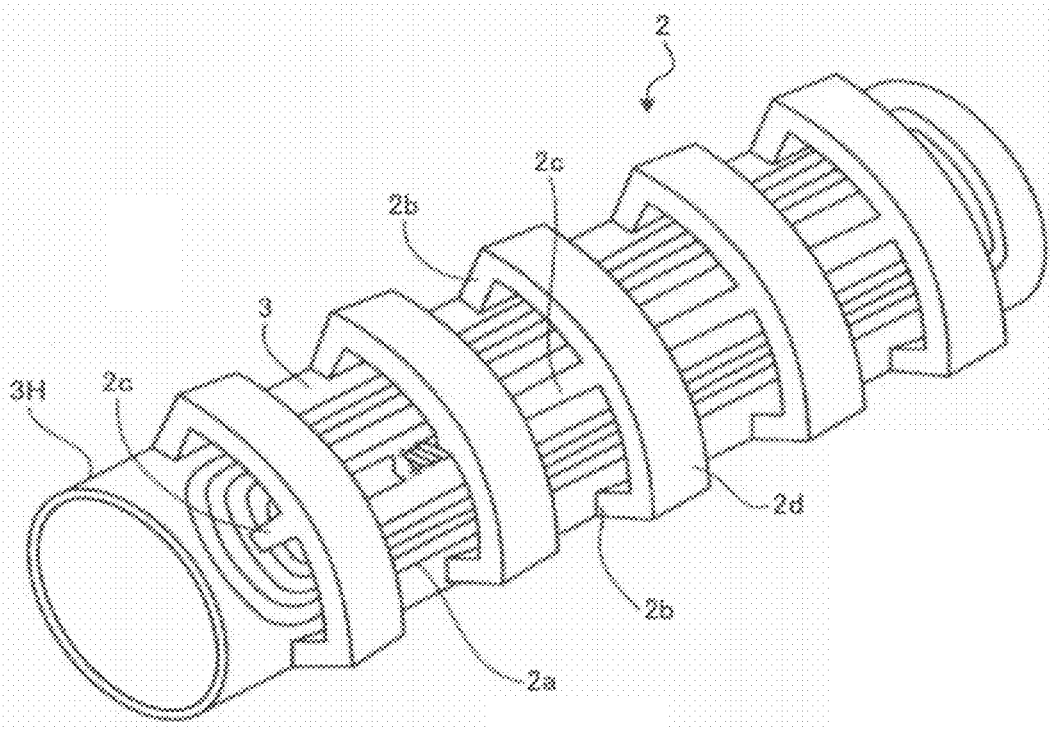
FIG. 13 is a perspective view which exemplifies configurations of an exciting coil and a core.
Figure 14:
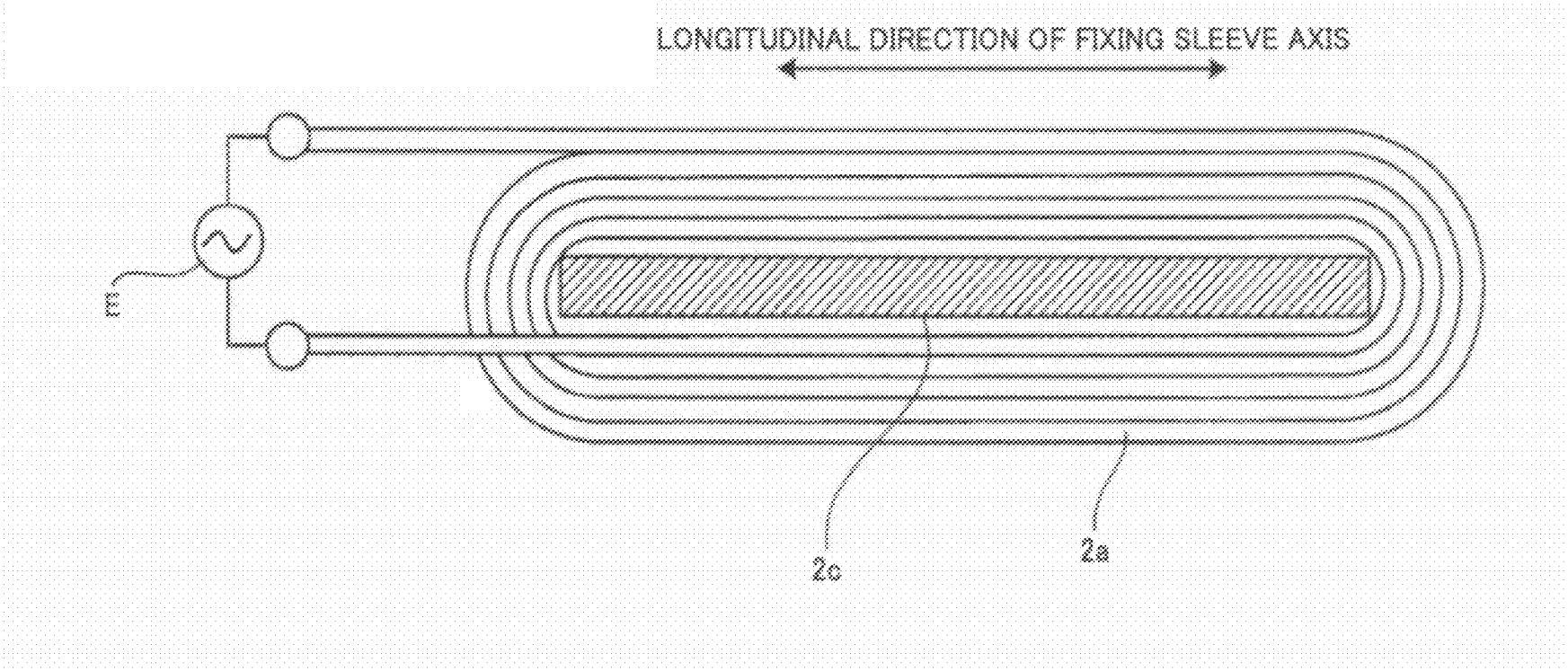
FIG. 14 is a front view of the exciting coil.

The magnetic flux generator 2 includes a center core 2*c* at the center; an arch core 2*d*, which includes leg cores 2*b* at both ends, and an exciting coil 2*a*. The exciting coil 2*a* is the same as that described with respect to FIGS. 12 to 14. As described in FIG. 14, the exciting coil 2*a* is high frequency driven by an inverter E, which is an induction heating circuit, so that a high frequency magnetic field is generated. The magnetic field causes an eddy current to flow through the fixing sleeve 300H made of metal to raise a roller temperature. A sheet S bearing toner Tn is heated, pressed, and fixed when it passes between the fixing sleeve 300H and the pressurizing roller 4 in such a manner to cause a toner face to contact the fixing sleeve 300H.

Figure 3:
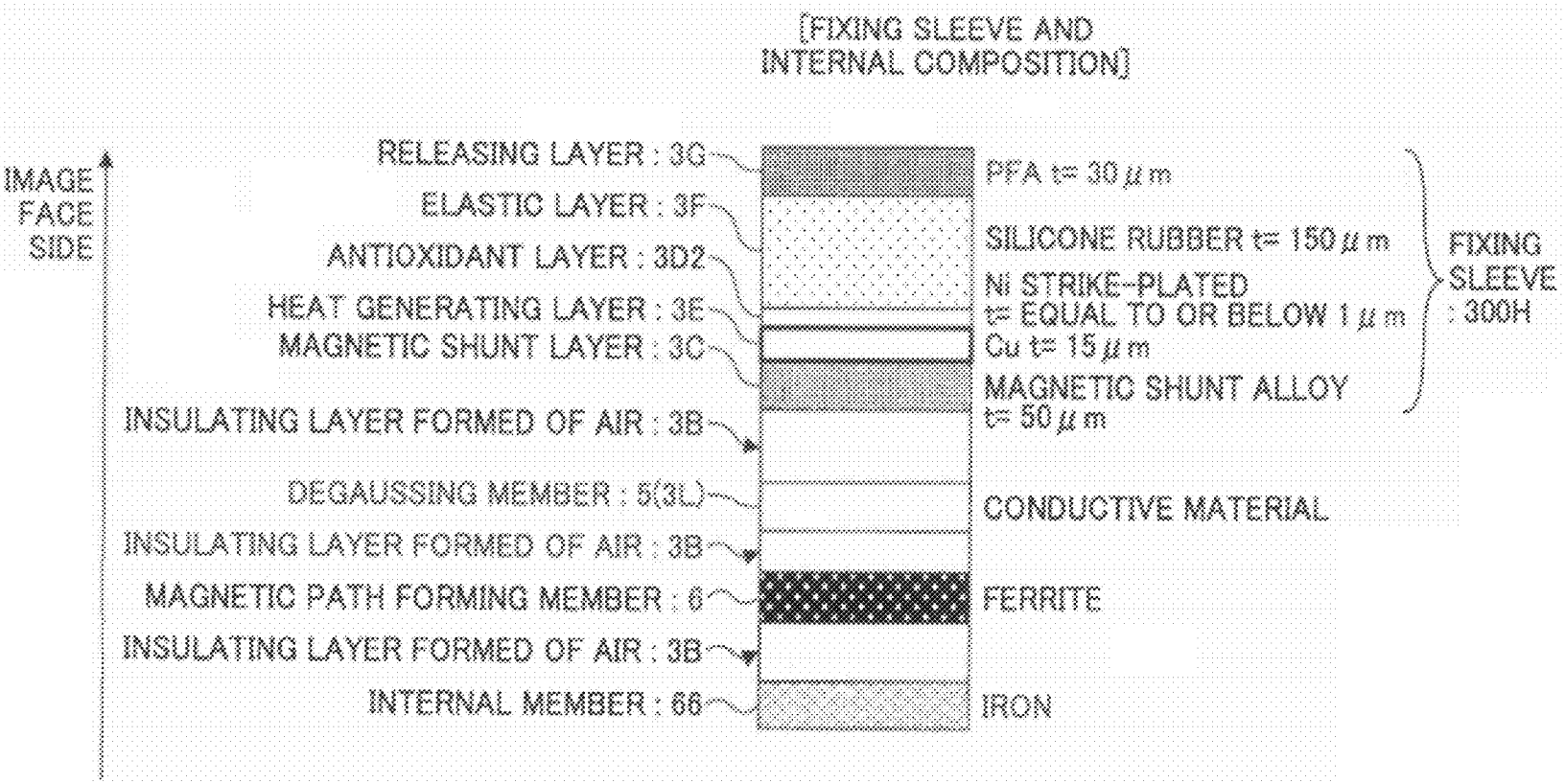
FIG. 3 is a diagram illustrating a schematic visual cross section of a portion of a fixing roller shown in FIG. 2 that is cut out in a radial direction.
Figure 15:
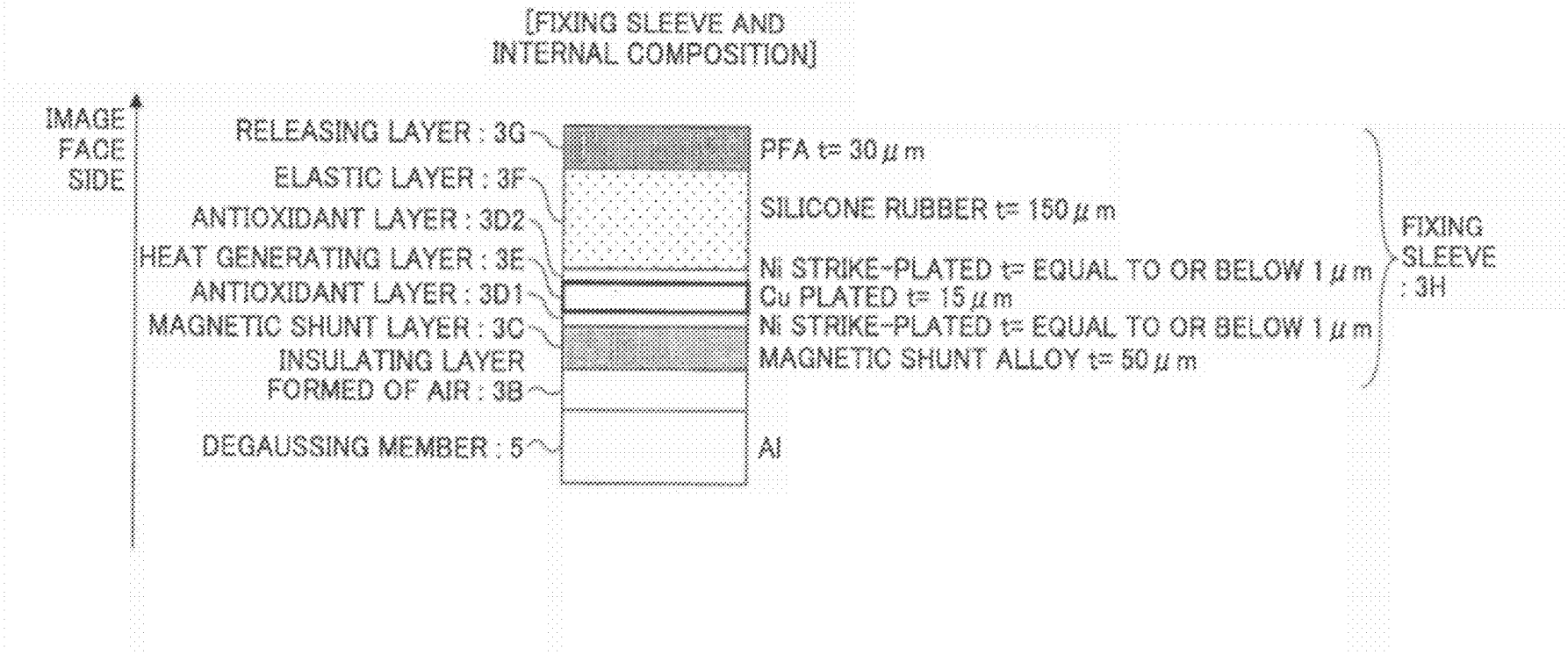
FIG. 15 is a schematic visual diagram illustrating a cross section of the fixing roller in a radial direction.
Figure 16A:
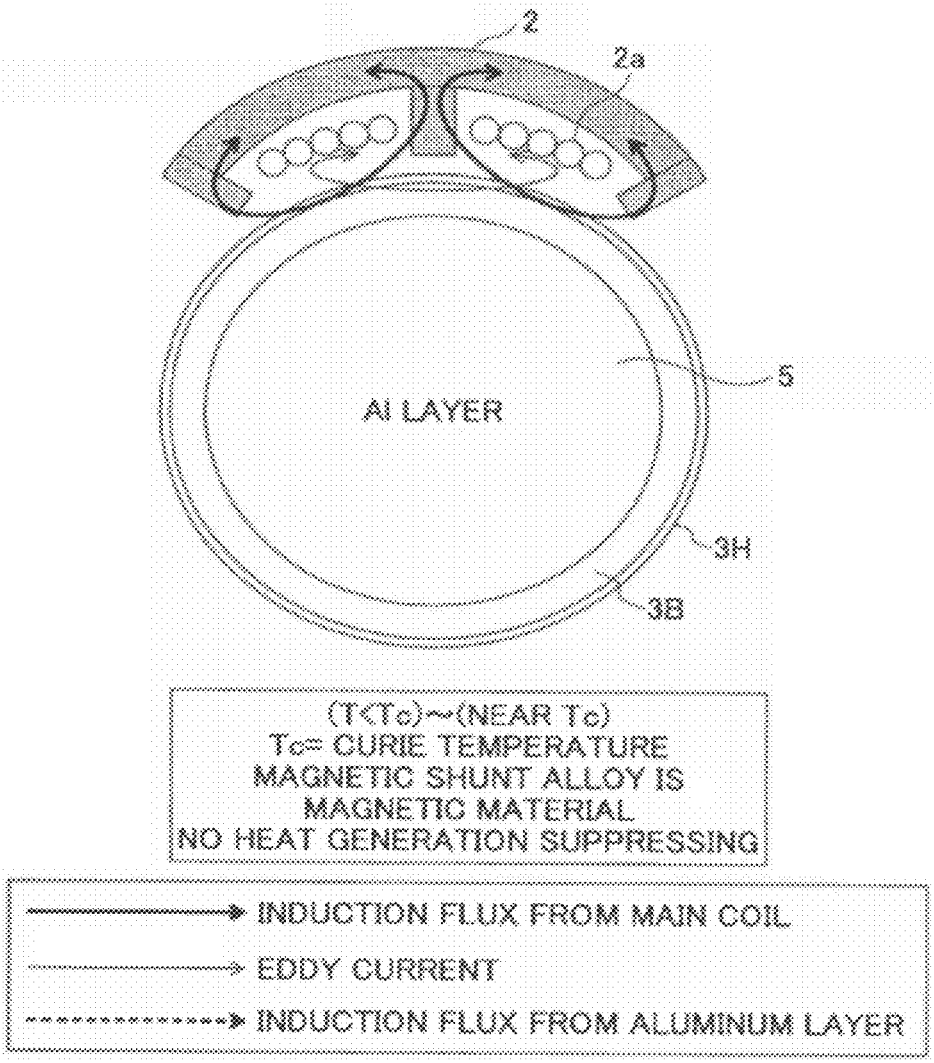
FIG. 16A is a schematic visual diagram showing a relationship between an induction magnetic flux and an eddy current when there is no heat generation suppressing by a magnetic shunt alloy as well as a cross section of the fixing roller.
Figure 16B:
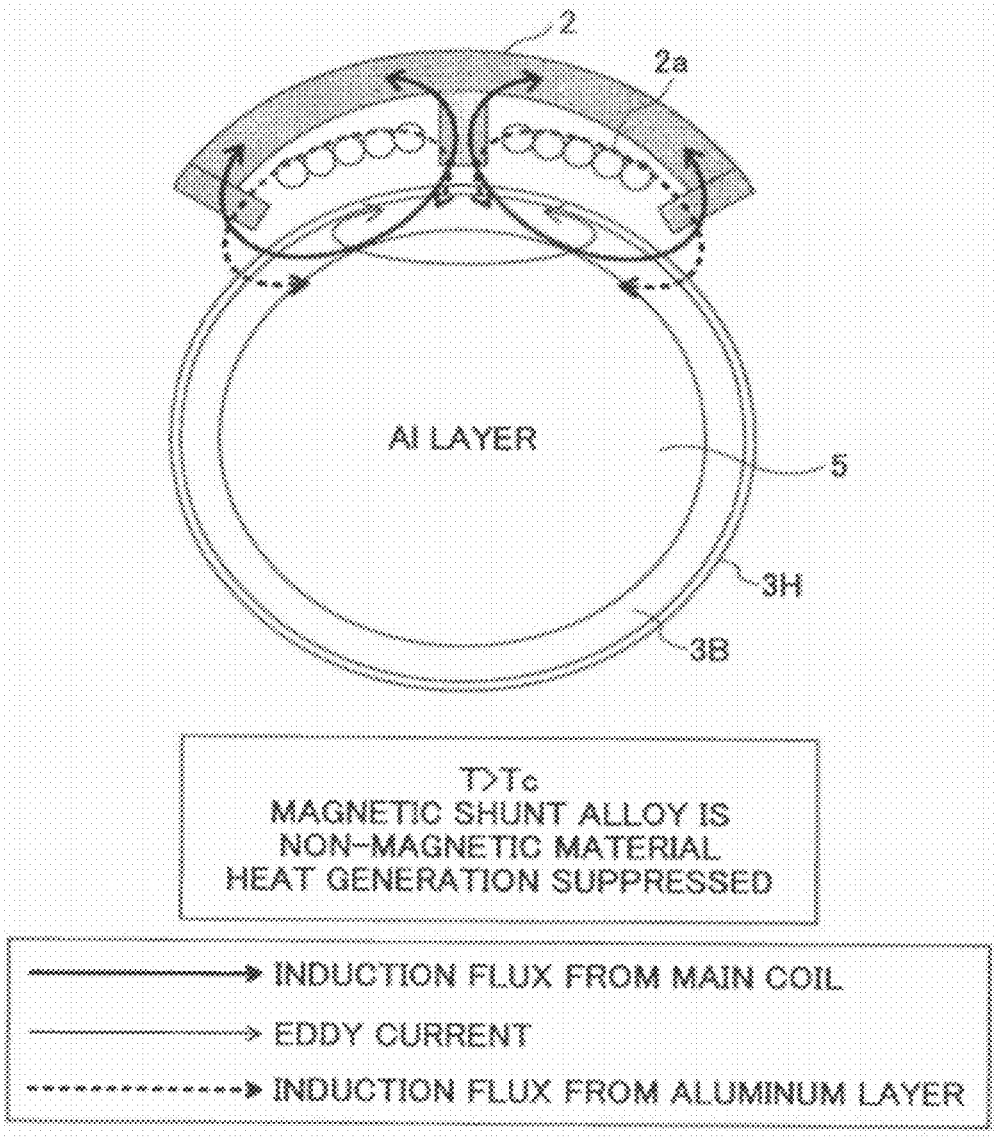
FIG. 16B is a schematic visual diagram showing a relationship between the induction magnetic flux and the eddy current when there is heat generation suppressing by the magnetic shunt alloy as well as the cross section of the fixing roller.

In FIG. 3, which shows a schematic visual cross section (shows an order of arrangement and is not limited to the feature in which all are stacked) of a portion of the fixing roller 300 that is cut out in a radial direction, the feature of the fixing sleeve 300H differs from the fixing sleeve 3H in FIG. 15 in that, while both sides of the thickness direction of the heat generating layer 3E in FIG. 15 are sandwiched by the antioxidant layers, the heat generating layer 3E does not have an antioxidant layer at a portion bordering a magnetic shunt layer 3C.

The fixing sleeve 300H is configured as an integral sleeve with the magnetic shunt layer 3C, a heat generating layer 3E, an antioxidant layer 3D2, an elastic layer 3F, a release layer 3G of a surface layer, etc., toward the image face side of the sheet S, which is located at a nip portion as shown with an arrow.

As shown in FIG. 2, the fixing sleeve 300H has a diameter of 40 mm, for example, and includes the magnetic shunt layer 3C. Inside the fixing sleeve 300H is provided a degaussing coil 3L as a degaussing member 5, a nip portion relative to the pressuring roller 4 includes a nip member 55, and the degaussing coil 3L as the degaussing member 5 and the nip member are supported by an internal member 66.

A known and appropriate magnetic shunt alloy (for example, having a thickness of 300 μm) is used as material for the magnetic shunt layer 3C; a nickel strike plate (for example, having a thickness of 1 μm or below) is used as material for the antioxidant layer 3D2; Cu plating (for example, having a thickness of 15 μm) is used as material for the heat generating layer 3E; silicone rubber (for example, having a thickness of 150 μm) is used as material for the elastic layer 3F; and PFA (having a thickness of 30 μm) is used as material for the releasing layer 3G. In other words, a thickness from the magnetic shunt layer 3C to the surface of the releasing layer 3G is 200-250 μm, for example. However, these numerical values are merely exemplary.

Moreover, as shown in FIG. 2, the nip member 55 is provided such that the fixing roller 300 side becomes concave shaped along the nip member 55, so that separability of the sheet 5 from the fixing roller 300 becomes superior. In the embodiment shown, the fixing sleeve 300H, which includes the magnetic shunt layer 3C to the releasing layer 3G, deforms due to pressing of the pressurizing roller 4.

The magnetic shunt layer 3C, which is made of a magnetic material (a magnetic shunt alloy material which includes iron and nickel, for example) which is formed such that the Curie temperature falls in a range of 100-300° C., for example, is arranged such that it deforms due to pressing by the pressurizing roller 4 and forms a nip. The presence of the degaussing member 5 (the degaussing coil 3L in the present embodiment) which is arranged inside the fixing sleeve 300H and the magnetic shunt layer 3C makes it possible to prevent overheating of the heat generating layer 3E, etc. The prevention of heat generation is as described based on FIGS. 19A and 19B with respect to the related art.

In the fixing apparatus 20 in FIG. 2, a heat generating rotor, which is an example of the fixing sleeve 300H, forms a cylindrical body, the magnetic shunt layer 3C is formed as a part of the cylindrical body, the magnetic shunt layer 3C and the heat generating layer 3E are integrally formed, and the cylindrical body and the degaussing members (the degaussing coils 3L, 3L) are disposed with a second air gap Δ2 (corresponding to an insulating layer 3B formed of air in FIG. 3) inbetween. The fixing apparatus 20 includes the heat generating layer 3E; the exciting coil 2*a* which generates magnetic flux and inductively heats the heat generating layer 3E with the magnetic flux; the magnetic shunt layer 3C which senses temperature when heat is generated at the heat generating layer 3E; the degaussing coil 3L which cancels out induction magnetic flux from the exciting coil 2*a* with a repulsive magnetic flux (magnetic flux shown in an dotted-line arrow in the below-described FIG. 4B); and a switching element 16 as a magnetic flux adjusting unit which acts on the degaussing coil 3L to adjust the repulsive magnetic flux. Since at least the heat generating layer 3E and the magnetic shunt layer 3C make up the fixing sleeve 300H and the exciting coil 2*a* is arranged outside the fixing sleeve 300H and the degaussing coil 31 is arranged inside the fixing sleeve 300H, the magnetic shunt layer 3C moves between the exciting coil 2*a* and the degaussing coils 3L, 3L by rotation of the fixing sleeve 300H, so that a temperature of the heat generating layer 3E is controlled by a self temperature control function using the Curie temperature of the magnetic shunt layer 3C.

Inside the fixing sleeve 300H is arranged the internal member 66 which supports the nip member 55, etc. The internal member 66 requires rigidity which withstands pressure of the nip portion, so that it is formed of a metal member such as iron, etc. Such a material is inductively heated due to a magnetic flux from the exciting coil 2*a*, so that if the magnetic flux penetrates through the degaussing coil 3L in the course of adjusting the repulsive magnetic flux by the switching element 16, an induced magnetic flux of the exciting coil 2*a* causes heat to be generated in the internal member 66. The switching element 16 is arranged such that, when the magnetic shunt alloy which makes up the magnetic shunt layer 3C reaches the Curie temperature, generating of the repulsive magnetic flux due to the degaussing coil 3L is switched on or off to make it possible to select the operation or non-operation of the self temperature control function of the magnetic shunt layer 3C. The degaussing member 5 is a coil, and repulsive magnetic flux is adjusted by opening and closing of a switch connected to both ends of a coil winding.

As shown in FIGS. 2, 4, etc., the degaussing coil 3L is formed such that it opposes a conducting line of the exciting coil 2*a* and is arranged opposing the exciting coil 2*a*. As shown in FIG. 2, the degaussing coil 3L is arranged such that first air gaps Δ1, Δ1, which are spaces inside the windings of the degaussing coils 3L, 3L are disposed at respectively corresponding positions which oppose both ends in the longitudinal direction of a series of inner space portions Δ3 of the coil that has a length in the longitudinal direction of the fixing roller axis that make up the exciting coil 2*a*. A portion of the center core 2*c* is located at the series of inner space portions Δ3.

As shown in FIGS. 2, 4, etc., the magnetic path forming member 50 has a generally T-letter shape which includes a portion such that a shape of the fixing roller 300 as viewed from the axial longitudinal direction has a length in the lateral direction and a portion which protrudes upward from a generally central part of the portion having the length in the lateral direction. As shown, the portion which protrudes upward penetrates the first air gap Δ1 which opposes the inner space portion Δ3 of the exciting coil 2*a*. Moreover, the portion having the length in the lateral direction is closely spaced to and opposes the degaussing coil 3L, or supports the degaussing coil 3L on the magnetic path forming member 50. In this way, a portion of the channel forming member 50 (a portion 50*a* which protrudes upward) is arranged in the first air gap Δ1.

Figure 4A:
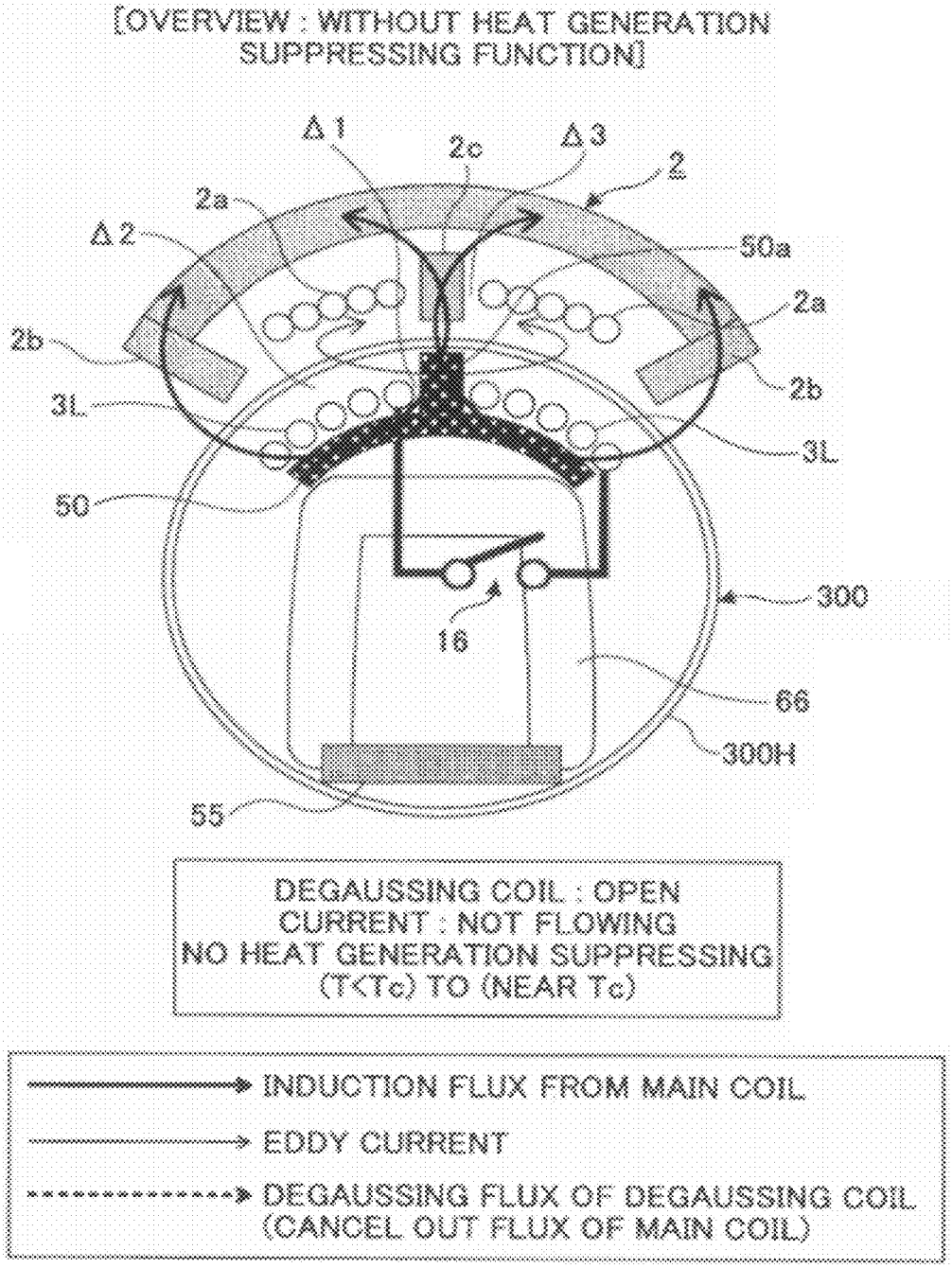
FIG. 4A is a diagram illustrating a schematic visual cross-section of the fixing roller which makes up the fixing apparatus according to an embodiment of the present invention and a relationship between an induction magnetic flux and an eddy current in a case without heat generation suppressing.
Figure 4B:
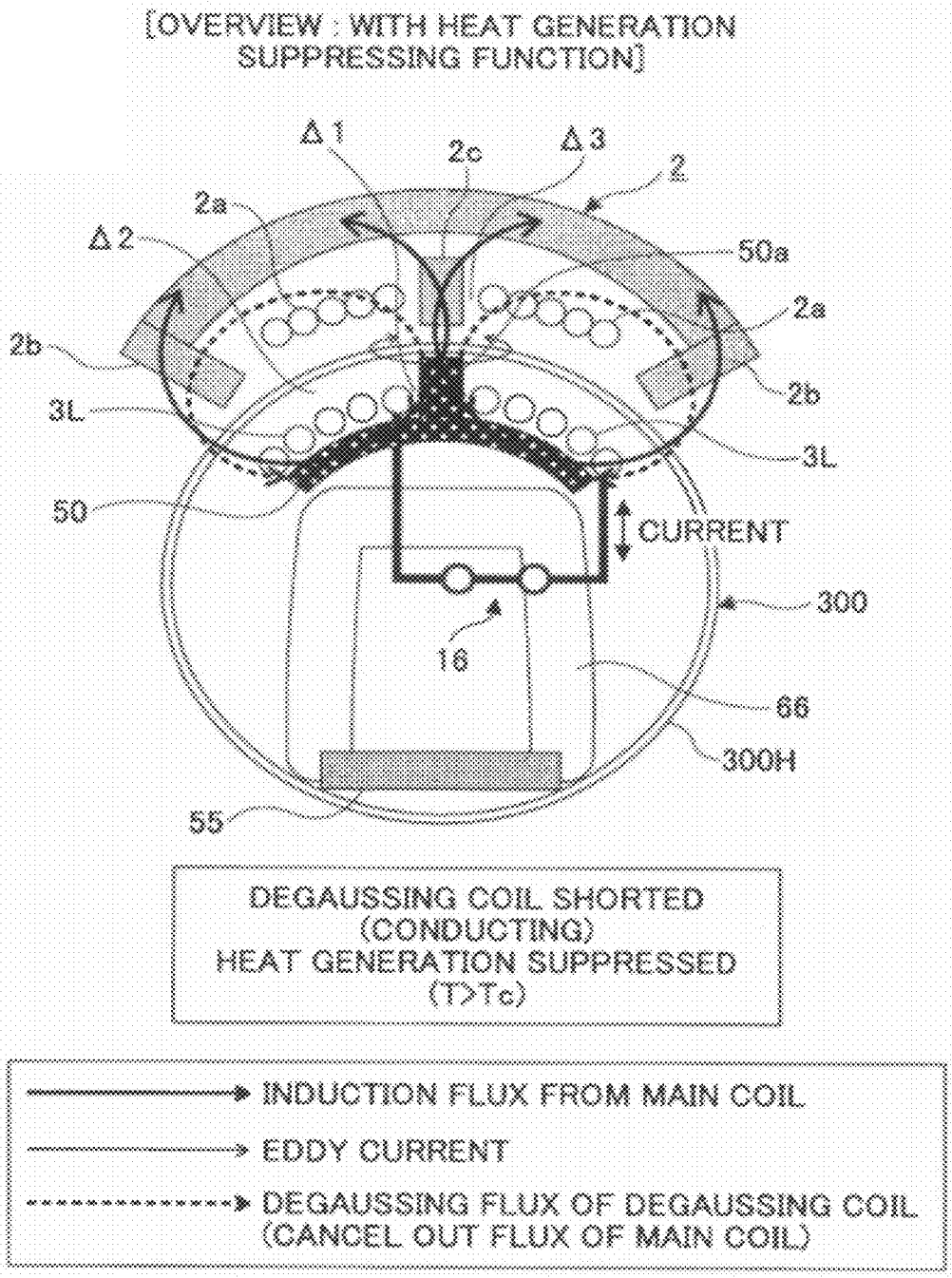
FIG. 4B is a diagram illustrating the schematic visual cross-section of the fixing roller which makes up the fixing apparatus according to an embodiment of the present invention and the relationship between the induction magnetic flux and the eddy current in a case with the heat generation suppressing.

Modes of temperature control in each of a case with heat generation suppressing and a case without heat generation suppressing in the fixing apparatus having the configurations shown in FIGS. 2 and 3 are described according to FIGS. 4A and 4B.

Figure 19A:
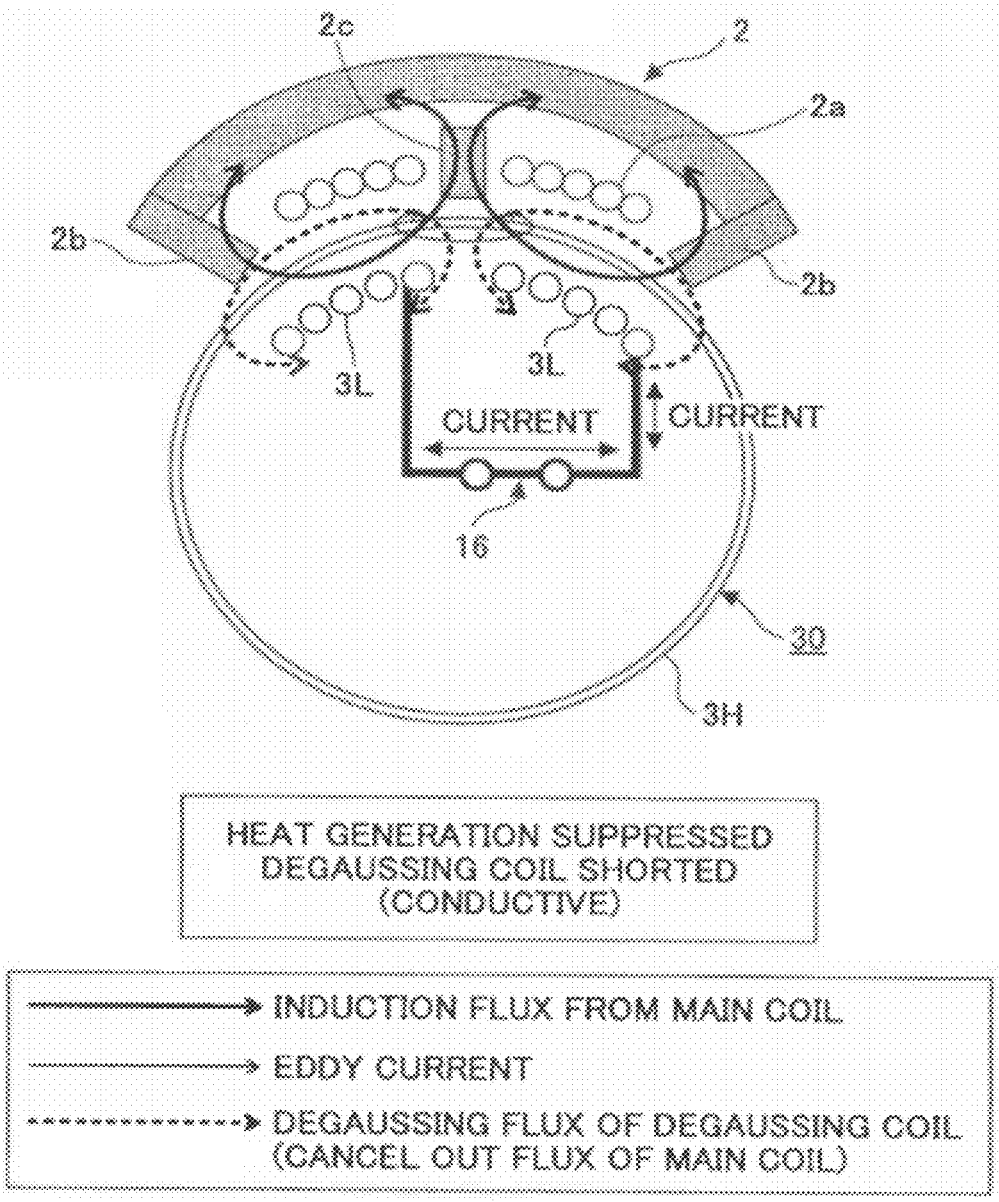
FIG. 19A is a schematic visual diagram showing a relationship between induction magnetic flux and an eddy current at the time of turning on the degaussing coil as well as a cross section of the fixing roller having a magnetic flux adjusting unit.
Figure 19B:
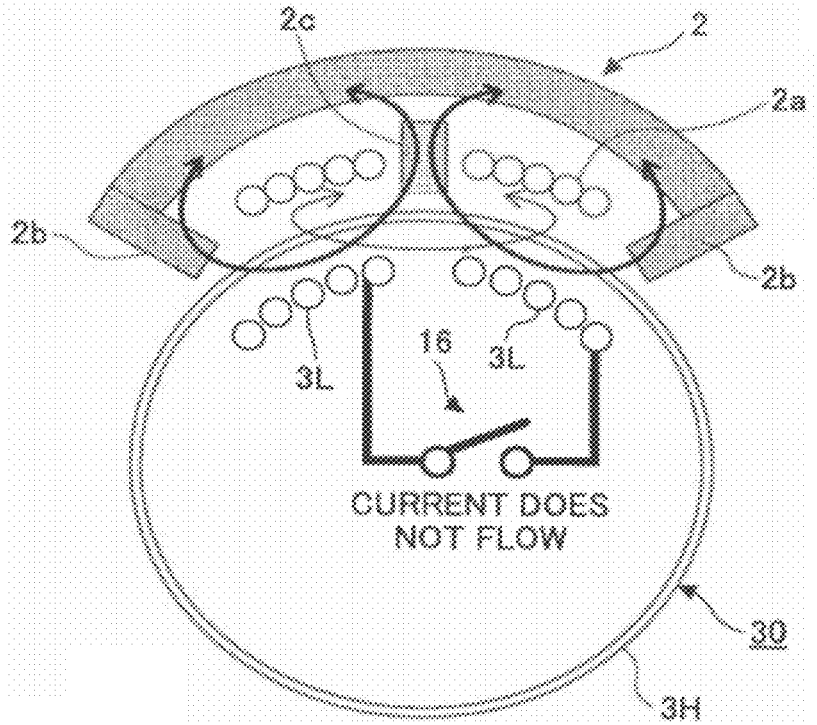
FIG. 19B is a schematic visual diagram showing the relationship between the induction magnetic flux and the eddy current at the time of turning off the degaussing coil as well as a cross section of the fixing roller having a magnetic flux adjusting unit.
Figure 20:
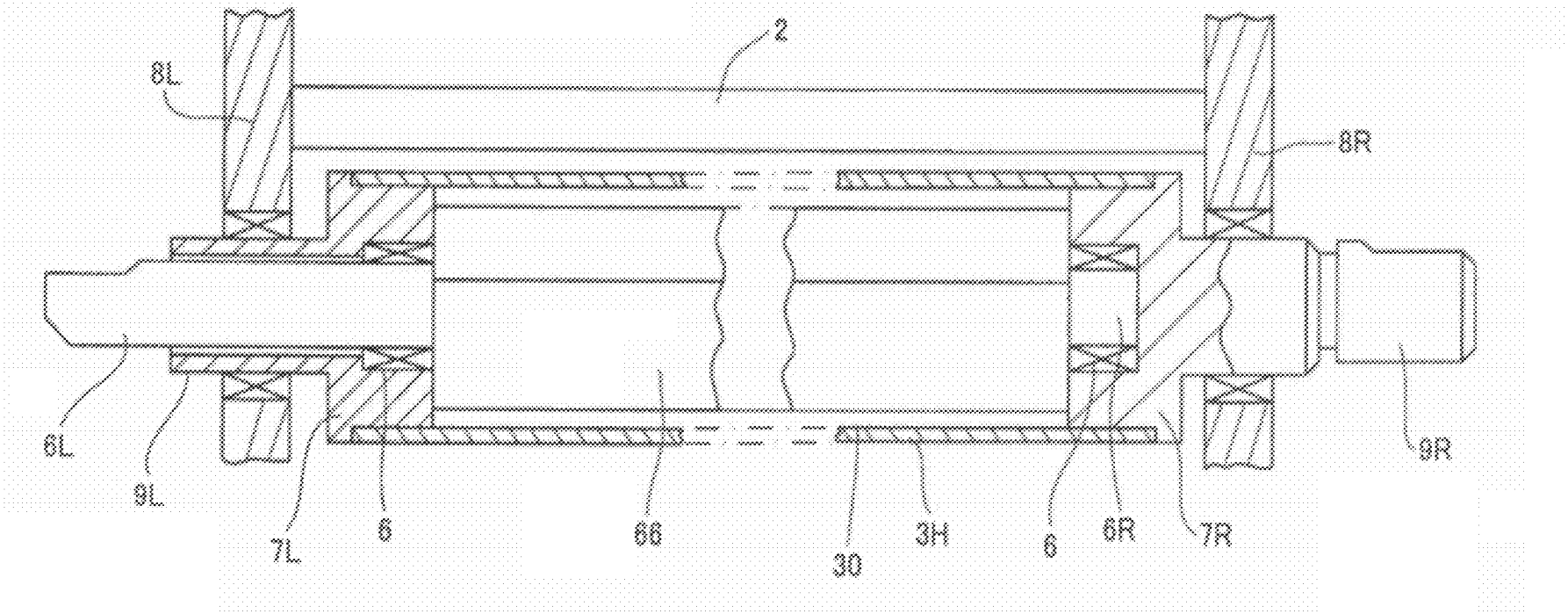
FIG. 20 is cross-sectional diagram which explains a supporting structure of the degaussing coil.

FIG. 4A corresponds to FIG. 19B, while FIG. 4B corresponds to FIG. 19A. A bold solid-line arrow denotes an induction magnetic flux from the exciting coil 2*a*, a thin solid-line arrow denotes an induction current (an eddy current) generated at the heat generating layer 3E by the time-varying induction magnetic flux, and a broken-line arrow denotes a degaussing magnetic flux from the degaussing coil 3L. The switching element 16 is switched on or off in accordance with the temperature of the fixing sleeve. The degaussing coils 3L, 3L are disposed away from and on the opposing side of the exciting coil 2*a* with the fixing sleeve 300H inbetween.

As shown in FIG. 4A, when in a range from $T<Tc$ to T being near Tc, the switching element 16 is arranged to be turned off. This shows a state such that the magnetic shunt alloy which makes up the magnetic shunt layer 3C remains a magnetic body and the induction magnetic flux generated by the exciting coil 2*a* does not penetrate through the magnetic shunt layer 3C as the temperature T of the magnetic shunt alloy which makes up the magnetic shunt layer 3C is lower than the Curie temperature, in other words, this shows a state such that the magnetic shunt layer 3C does not pass through the magnetic flux at a temperature below the Curie temperature Tc and the induction magnetic flux has not reached the degaussing coil 3L. Thus, the induction magnetic flux by the exciting coil 2*a* makes it possible to generate an eddy current in the heat generating layer 3E without any constraint and to cause the heat generating layer 3E to generate heat as much as possible. In this case, heat generation is not suppressed, so that heat is generated at an efficiency of around 90%. The above-described state corresponds to a characteristic line which connects the Δ symbols at 180° C. or more in FIG. 22.

When it becomes T>Tc due to a temperature rise of the heat generating layer 3E, the switching element 16 is turned on as shown in FIG. 4B. When the temperature of the magnetic shunt layer 3C becomes the Curie temperature or above and the induction magnetic flux from the exciting coil 2*a* penetrates through the magnetic shunt layer 3C to reach the degaussing coil 3L, the induction magnetic flux is generated from the degaussing coil 3L as shown with a dotted-line arrow. The degaussing coil 3L is made of a conductive metal material, and the switching element 16, which is a magnetic flux adjusting unit which adjusts the repulsive magnetic flux with the induction magnetic flux from the degaussing coil 3L and which has a switching function, adjusts the repulsive magnetic flux by switching between conducting and non-conducting.

Even when the non paper passing portion rises in temperature excessively due to a small-sized paper passing, etc., as the temperature T of the magnetic shunt layer 3C is higher then the Curie temperature Tc, magnetism of the magnetic shunt alloy which makes up the magnetic shunt layer 3C is lost, resulting in a non magnetic body, and the induction magnetic flux from the exciting coil 2*a* has reached the degaussing coil 3L, the induction current does not flow in the degaussing coil 3L when the switching element 16 remains in an off state as shown in FIG. 4A, so that the degaussing function is not operated.

On the other hand, when the switching element 16 is switched on as shown in FIG. 4B, the degaussing function operates in the degaussing coil 3L and the degaussing magnetic flux (reverse magnetic flux) relative to the induction magnetic flux from the exciting coil 2*a* is generated, so that an effective magnetic flux which penetrates through the heat generating layer 3E decreases.

The magnetic shunt layer 3C, which is a magnetic body (including the above-described function of the heat generating layer 3E), almost instantaneously rises in temperature before it reaches the Curie temperature Tc, and loses magnetism when it reaches the Curie temperature Tc, so that it no longer rises in temperature, thus maintaining a constant temperature. Therefore, when the magnetic shunt layer 3C is arranged such that the Curie temperature of the material which makes up the magnetic shunt layer 3C falls in a range of 100-300° C., which is a range of temperature in this type of fixing apparatus, the heat generating layer of the fixing sleeve 300H may not overheat, so that the Curie temperature may generally be maintained, without undermining high releasability, heat resistance, etc., at the surface of the fixing roller 3 and without needing complex control.

Figure 17:
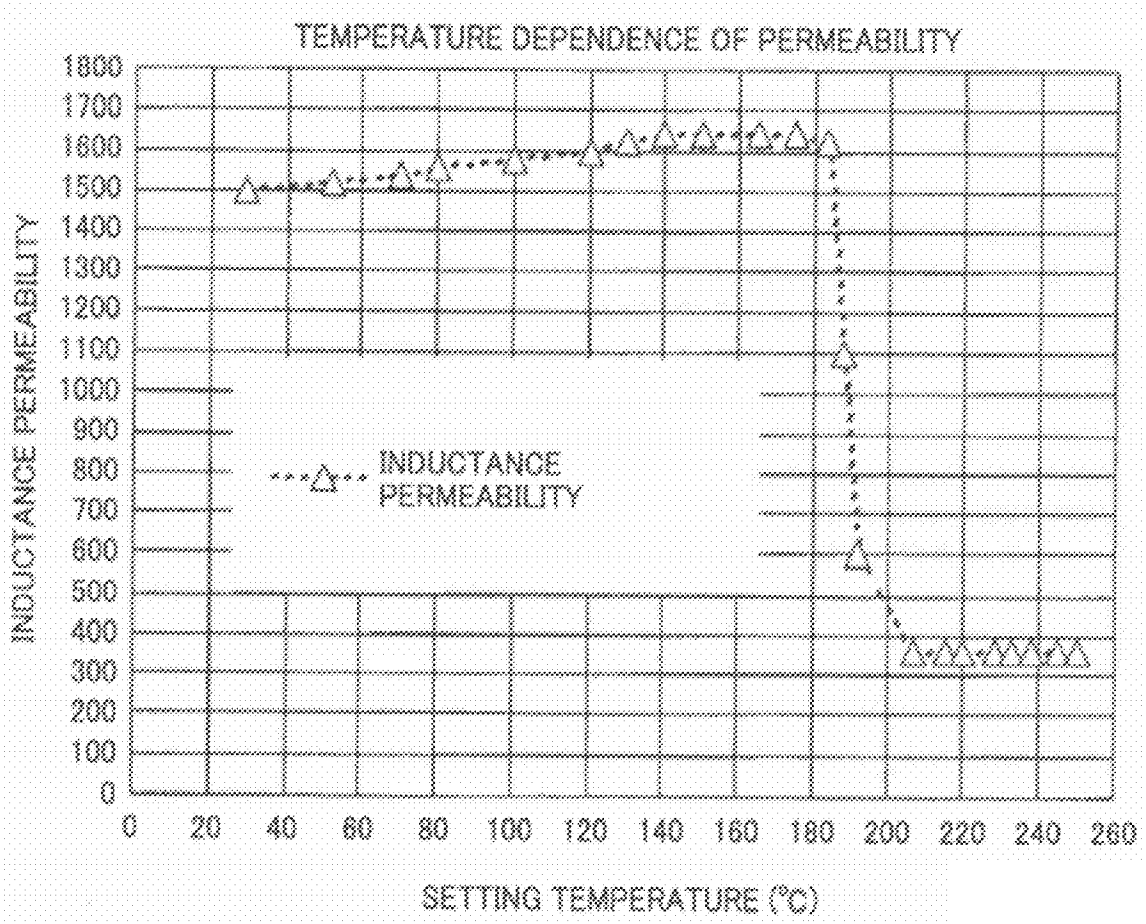
FIG. 17 is a diagram illustrating temperature dependence of permeability (heat generation efficiency) of the magnetic shunt layer 3C.
Figure 18:
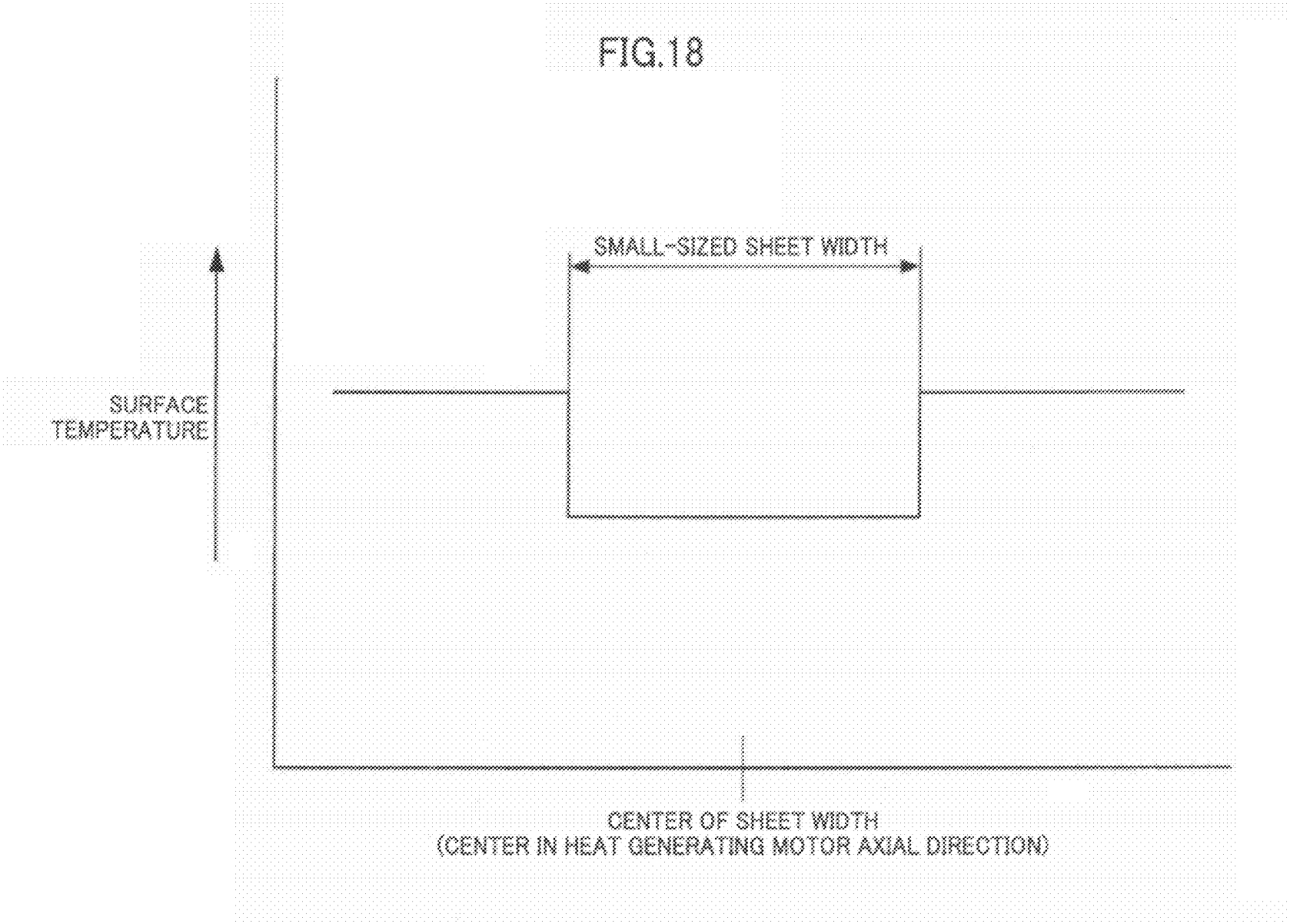
FIG. 18 is a diagram schematically illustrating a state of temperature dropping at a center portion due to consecutive sheets of small-sized paper passing.
Figure 22:
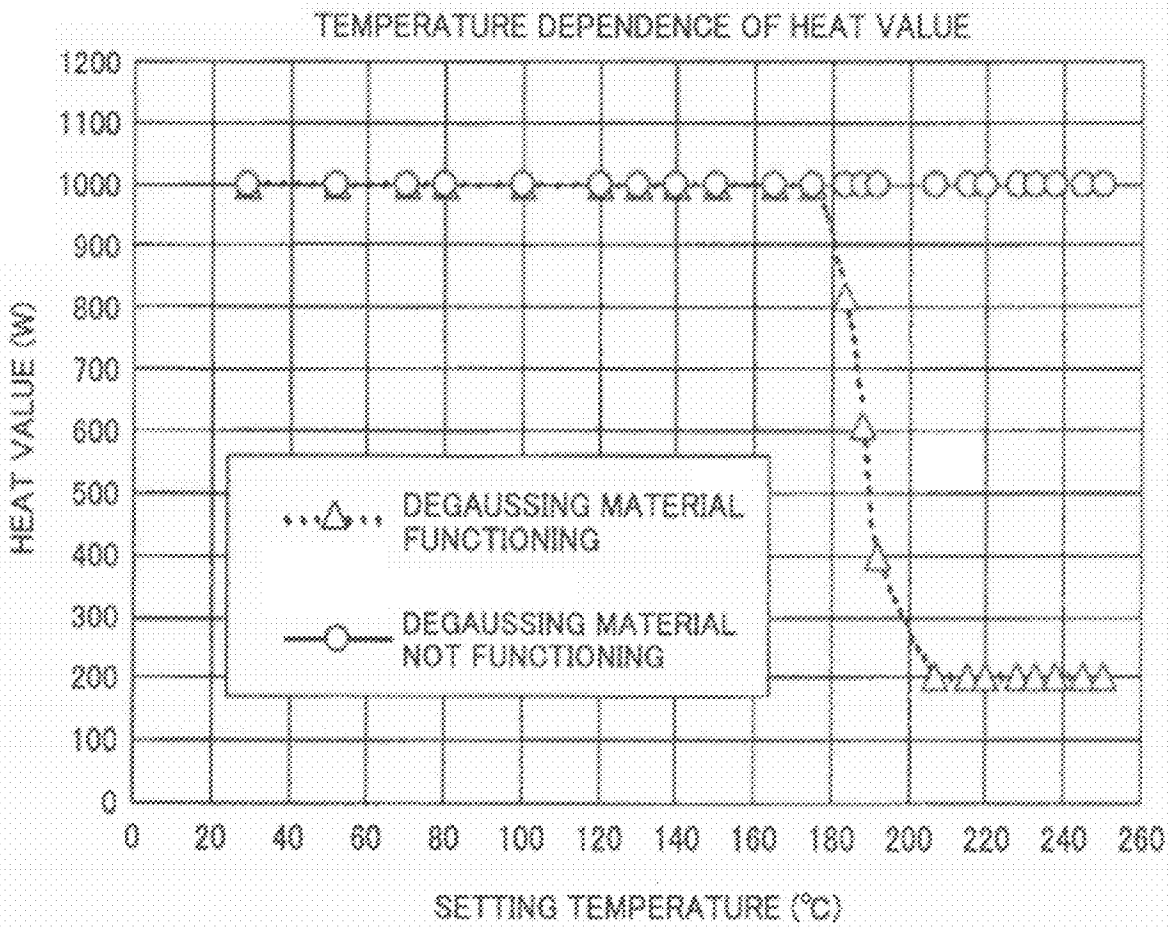
FIG. 22 is a diagram illustrating a temperature dependence of heat generation efficiency.

As described in FIG. 17, the permeability for the respective temperatures shown with Δ symbols drastically falls when the temperature exceeds the setting temperature. As described with respect to FIG. 22, this directly correlates with the heat value of the apparatus, so that when the switching element 16 of the degaussing circuit is off and the degaussing coil 31 is not shorted, the heat value does not fall, whereas when it is shorted, the heat value falls depending on the Curie temperature as shown in FIG. 22.

Figure 23B:
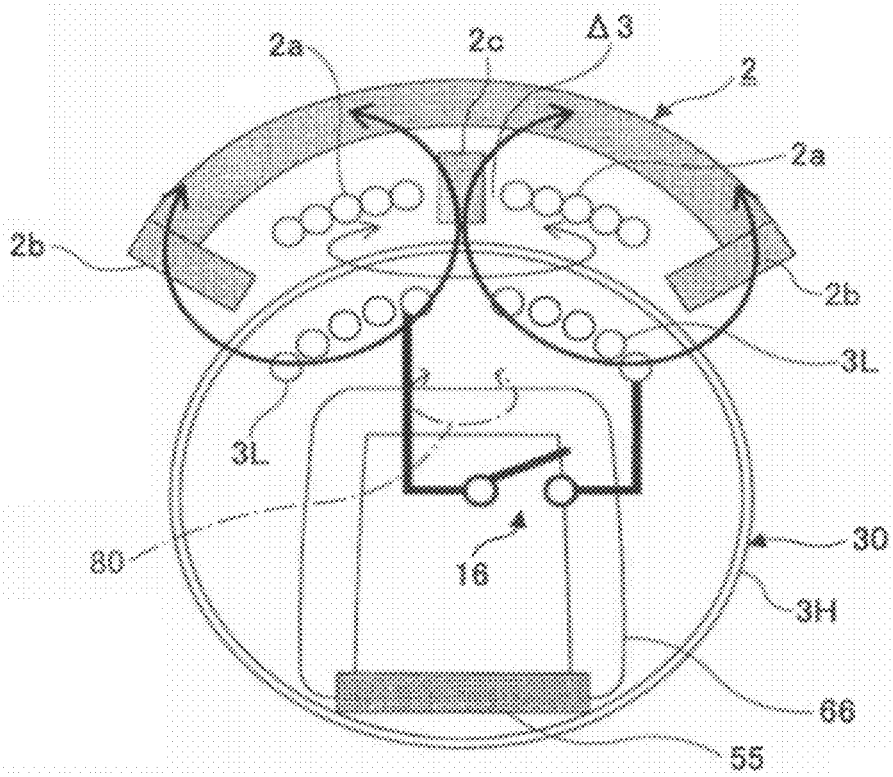
FIG. 23B is a diagram which corresponds to FIG. 19B and which assumes a case of $T>Tc$ with the impact of the internal member in the switch open state being additionally included in order to take into account the impact.

In embodiments of the present invention, as described with respect to FIG. 23B, to deal with a problem such that, when the degaussing coil 3L as a degaussing member is not shorted, the induction magnetic flux from the exciting coil 2*a* acts on the internal member 66 inside the fixing sleeve 300H, so that heat generating loss occurs. The magnetic path forming member 50, which forms a magnetic path of the exciting coil 2*a*, is arranged on the back face side of the degaussing coil 3L which is on the opposite side of the magnetic shunt layer (a magnetic shunt layer in an area which opposes the magnetic flux generating unit 2 out of the fixing sleeve 300H) with the degaussing coil 3L inbetween such that it covers the internal member 66, as shown in FIGS. 2 and 4.

The magnetic path forming member 50 forms a magnetic channel of the magnetic flux from the exciting coil 2*a* at a back face of the degaussing coil 3L, making it possible to suppress penetrating through of the magnetic flux and to suppress a heat generation loss due to the magnetic flux from the exciting coil 2*a* reaching the internal member 66. The magnetic path forming member 50 is preferably made of a material of a high permeability that is easy to induce the magnetic flux from the exciting coil 2*a* and is desirably a highly resistive material such that it itself is prevented from inductively generating heat therein. More specifically, it is preferably formed of a mold material, which includes soft ferrite and a magnetic body powder.

In this way, the magnetic channel forming member 50 which forms the magnetic path of the exciting coil 2*a* is supported by the internal member 66 in such a mode as to induce the induction magnetic flux from the exciting coil 2*a*, so that it magnetically shuts out the induction magnetic flux from the internal member 66. Thus, according to the present embodiment, a fixing apparatus, which is arranged to make a degaussing function controllable, makes it possible to adjust a self temperature control function, to set a temperature to an arbitrarily high temperature even when the magnetic shunt layer is being used, and to implement a suppression of a rapid warming up and a temperature overshoot, a heat generating loss which occurs in an internal member due to a magnetic flux which penetrates through a related-art degaussing member may be reduced. The degaussing coil 3L is preferably formed of a material having a lower resistivity than that of the magnetic shunt layer 3C. This improves the degaussing performance.

Embodiment 2-2

Figure 5:
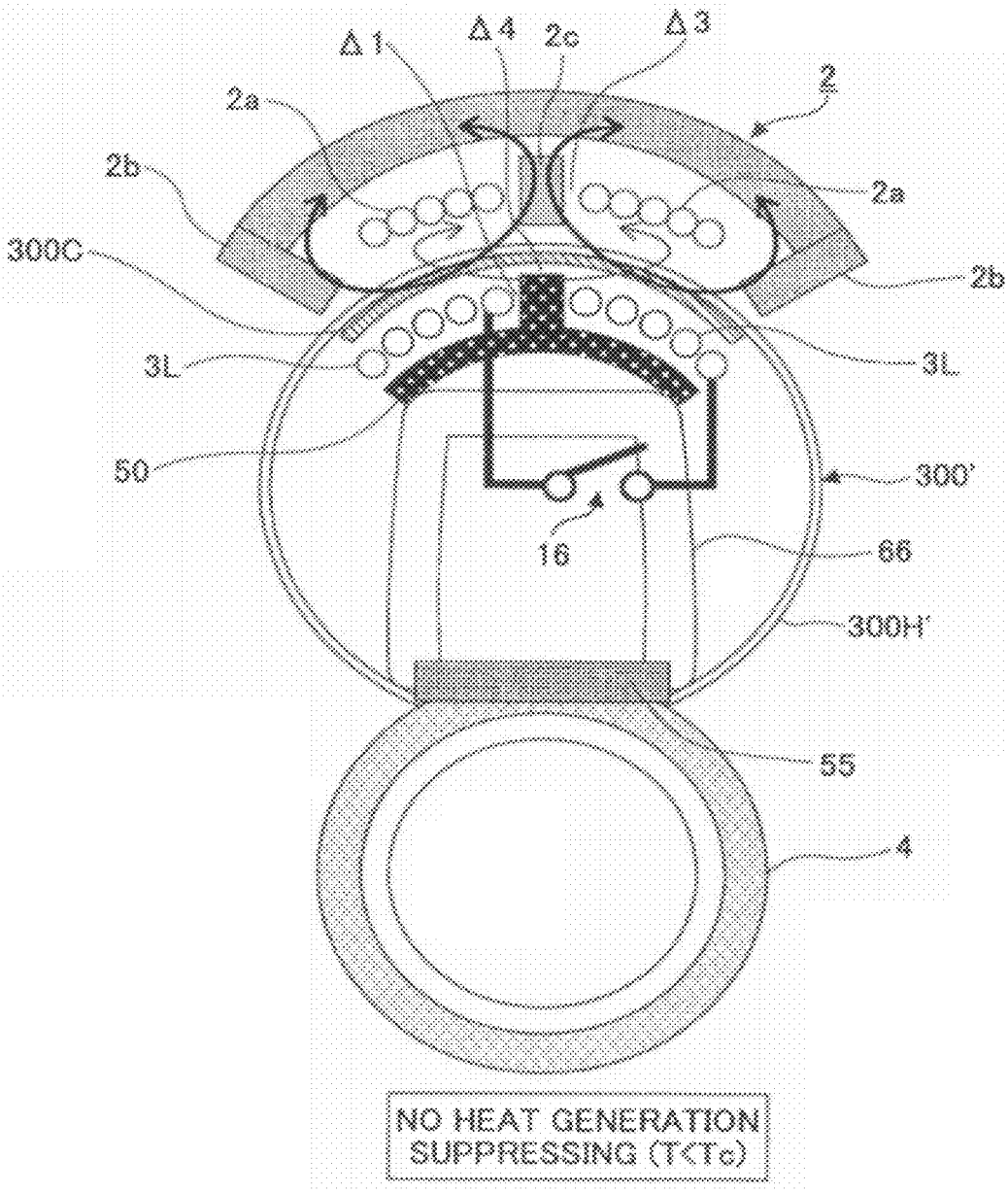
FIG. 5 is a diagram illustrating a configuration of a main part of the fixing apparatus according to an embodiment of the present invention.
Figure 6A:
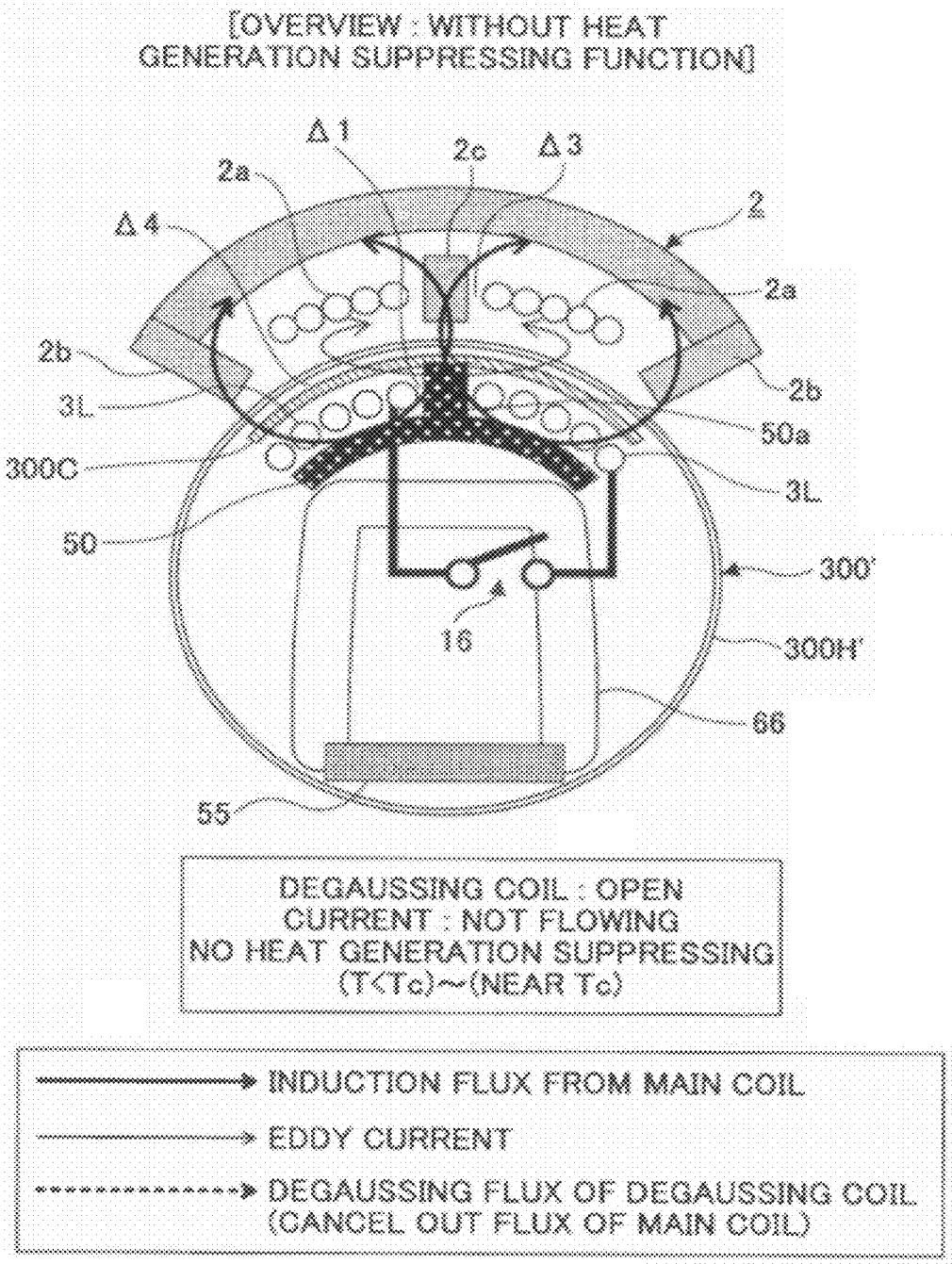
FIG. 6A is a diagram illustrating a schematic visual cross-section of the fixing roller which makes up the fixing apparatus according to an embodiment of the present invention and a relationship between an induction magnetic flux and an eddy current in a case without heat generation suppressing.
Figure 6B:
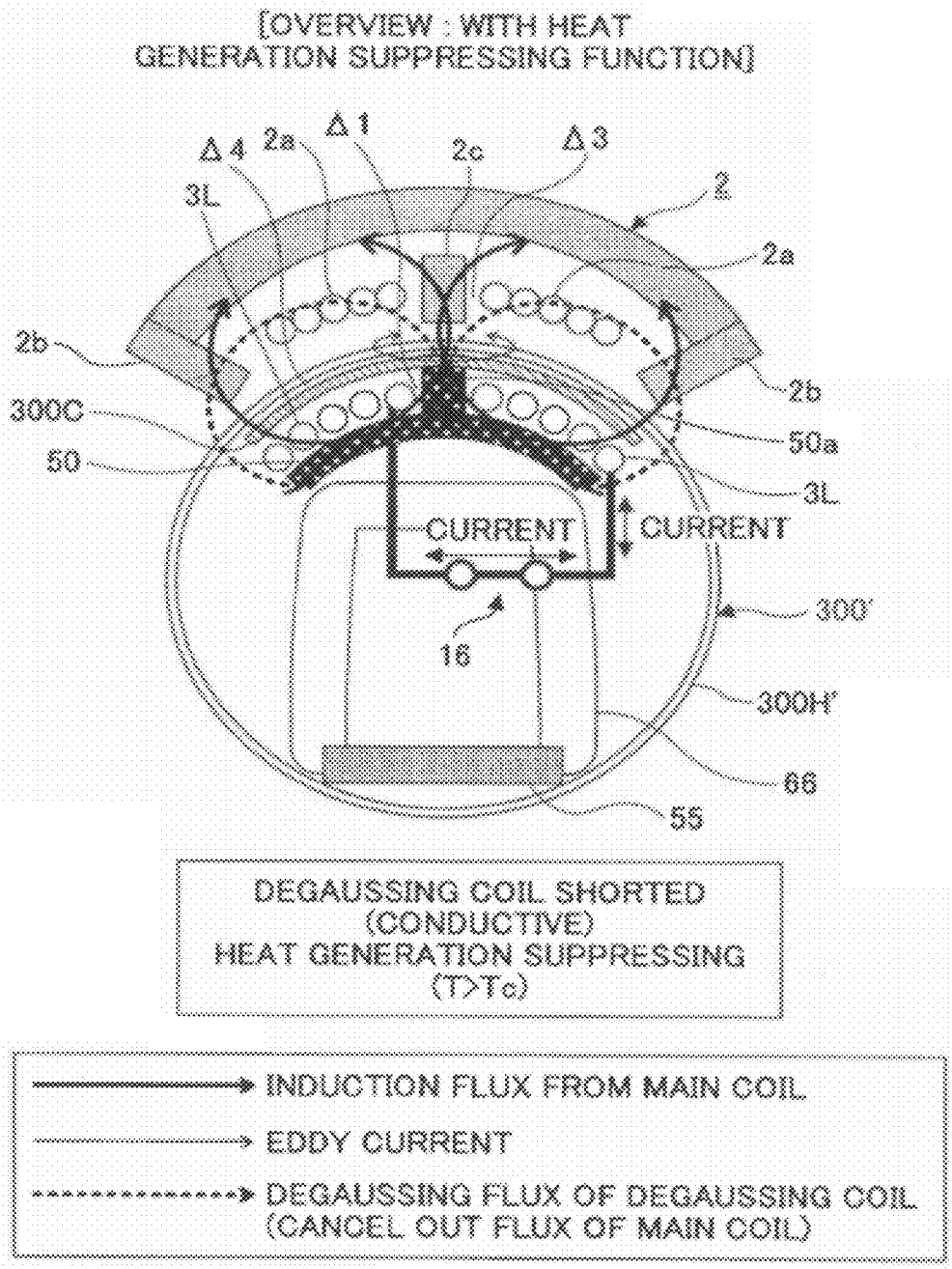
FIG. 6B is a schematic visual diagram illustrating a cross-section of the fixing roller which makes up the fixing apparatus according to an embodiment of the present invention and the relationship between the induction magnetic flux and the eddy current in a case with the heat generation suppressing.
Figure 7:
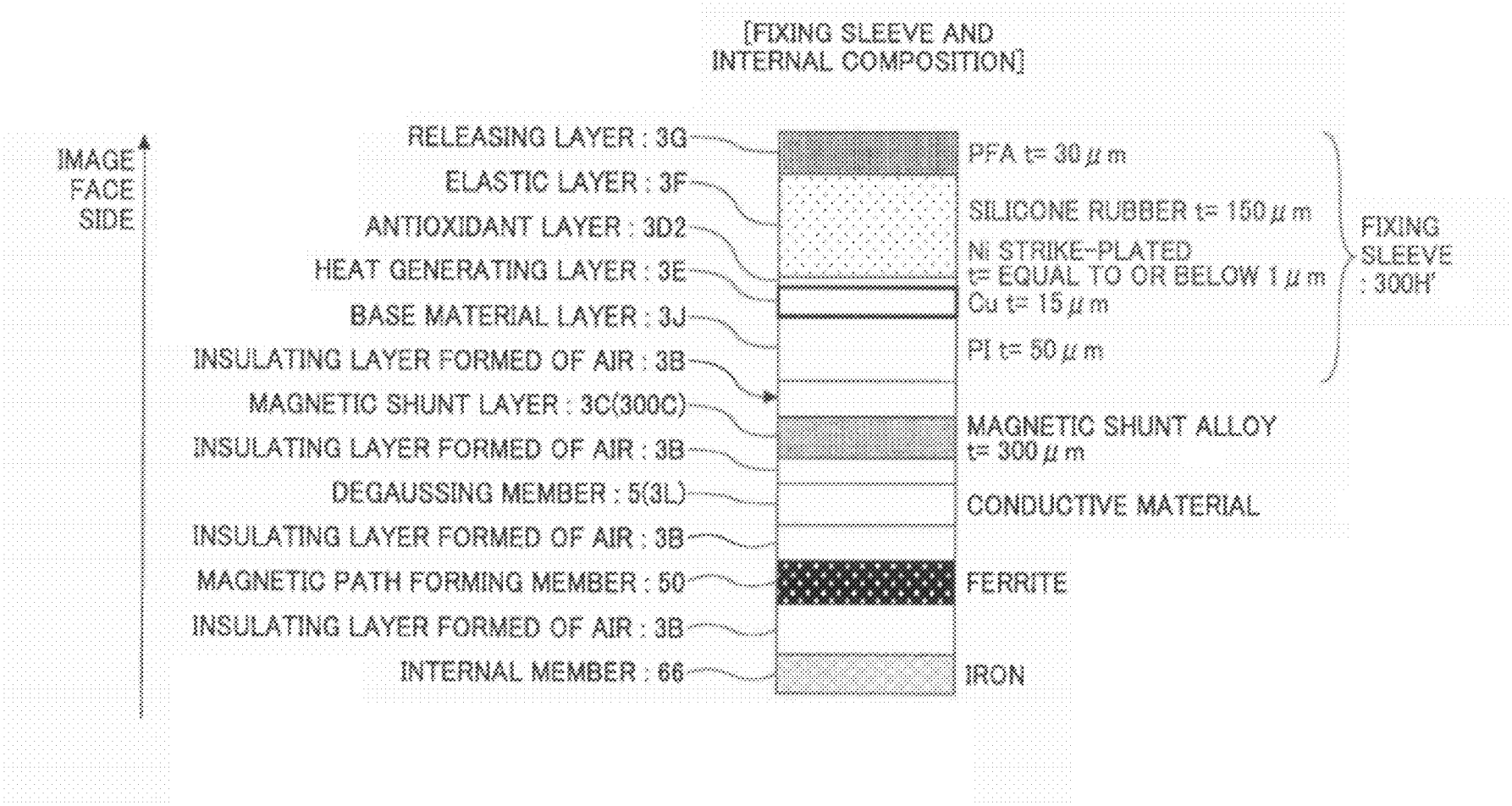
FIG. 7 is a diagram illustrating a schematic visual cross section of a portion of the fixing roller in FIGS. 5, 6A, and 6B that is cut out in a radial direction.

Embodiment of Fixing Sleeve Such that Heat Generating Rotor has at Least a Heat Generating Layer and Such that the Magnetic Shunt Layer is Independently Formed within the Fixing Sleeve The present embodiment is an example of a fixing sleeve such that a heat generating rotor has at least a heat generating layer and such that a magnetic shunt layer is independently formed inside the fixing sleeve, which configuration and operating mode are shown in FIGS. 5 to 7.

In FIG. 5, which shows the configuration of a main part of the fixing apparatus according to the present embodiment, the difference between a fixing roller 300' according to the present embodiment and the fixing roller 300 in the above-described embodiment 2-1 is that, while the magnetic shunt layer 3C is included in the fixing sleeve 300H in the fixing roller 300 in the embodiment 2-1, in the present embodiment the magnetic shunt layer 3C is configured inside the fixing sleeve 300H' as a magnetic shunt plate 300C, a body which is separate from the fixing sleeve 300H'. In other words, forming the magnetic shunt plate 300C with a curved plate which follows an inner peripheral face of the fixing sleeve 300H', which is a cylindrical body including the heat generating layer 3E, makes it possible to decrease the sliding resistance when it is slid on and rubbed against the inner peripheral face of the fixing sleeve 300H'.

In this way, while arranging the magnetic shunt layer 3C such that it is in contact with the fixing sleeve 300H' makes it possible to improve the temperature-sensing performance and immediately transfer heat in response to excessive temperature rise of the fixing sleeve 300H', it is also possible to provide an air gap of less than or equal to 1 mm and cause the magnetic shunt alloy which makes up the magnetic shunt layer 3C to sense temperature when heat is transferred through the above-described air gap.

Moreover, it is desirable that a magnetic material (a protruding portion 50*a* of the magnetic path forming member 50) which penetrates within the degaussing member air gap (the first air gap Δ1) is arranged away from the magnetic shunt plate 300C via the air gap Δ4. This is because the heat from the fixing sleeve 300H' flows in almost directly, so that heat capacity increases.

On the other hand, in an embodiment shown in FIGS. 6A and 6B such that the embodiment in FIG. 5 is modified, the magnetic shunt plate 300C is arranged with a fourth air gap Δ4 of a size of 1 mm, for example, being provided relative to the inner face of the fixing sleeve 300H', which is different from FIG. 5. The above-described difference is designed to decrease the heat capacity of the fixing sleeve 300H'. In this case, relative to the magnetic shunt plate 300C, a magnetic material (a protruding portion 50*a* made of the magnetic material 50) which penetrates within the degaussing member air gap (the first air gap Δ1) may be arranged such that it is in contact with the magnetic shunt plate 300C to improve the magnetic coupling of the magnetic shunt plate 300C and the magnetic path forming member 50 and to enhance the degaussing effect.

FIG. 6A shows a state of generation of a magnetic flux and an eddy current in a case without heat generation suppressing and FIG. 6B shows the state of generation of the magnetic flux and the eddy current in a case with heat generation suppressing. As these modes respectively correspond to the case without heat generation suppressing in FIG. 4A in the embodiment 2-1 and the case with heat generation suppressing in FIG. 4B in the embodiment 2-1, the state of operating the magnetic shunt function is the same, so that repeated explanations are omitted.

FIG. 7 shows a schematic visual cross section (which shows a sequence of arrangement and which is not limited to all being stacked) of a portion of the fixing roller in FIGS. 5 and 6 that is cut in a radial direction. In FIG. 7, the internal member 66 is provided on the innermost side, and the insulating layer 3B formed of air; the magnetic path forming member 50; the insulating layer 3B formed of air; the degaussing member 5 (the degaussing coils 3L, 3L); the magnetic shunt layer 3C by means of the magnetic shunt plate 300C; the insulating layer 3B formed of air; a base material layer 3J; the heat generating layer 3E; the antioxidant layer 3D2; the elastic layer 3F; and the releasing layer 3G of the surface layer are arranged toward the image face side of the sheet S located at the nip portion as shown with an arrow in the outward direction. Of these, the base material layer 3J, the heat generating layer 3E, the antioxidant layer 3D2, the elastic layer 3F, the releasing layer 3G, etc., make up a fixing sleeve 300H', which is an integral heat generating rotor.

The internal member 66 is made of iron; the magnetic forming member 50 is made of ferrite; the degaussing member 5 uses a degaussing coil 3L made of a conductive material; the base material layer 3J is made of PI with t=50 μm; the heat generating layer 3E is made of Cu with t=15 μm; the antioxidant layer 3D2 is made of nickel strike plating (with a thickness of less than or equal to 1 μm, for example); the elastic layer 3F is made of silicone rubber (with a thickness of 150 μm, for example); and the releasing layer 3G is made of PFA (with a thickness of 30 μm), etc.

Embodiment 2-3

Embodiment with Degaussing Member Being Conductive Plate

In the present embodiment, a degaussing member is arranged in a manner such that plate shaped low resistive bodies are connected, instead of using the degaussing coil 3L as in embodiments 2-1 and 2-2.

Figures 8A, 8B, 8C:
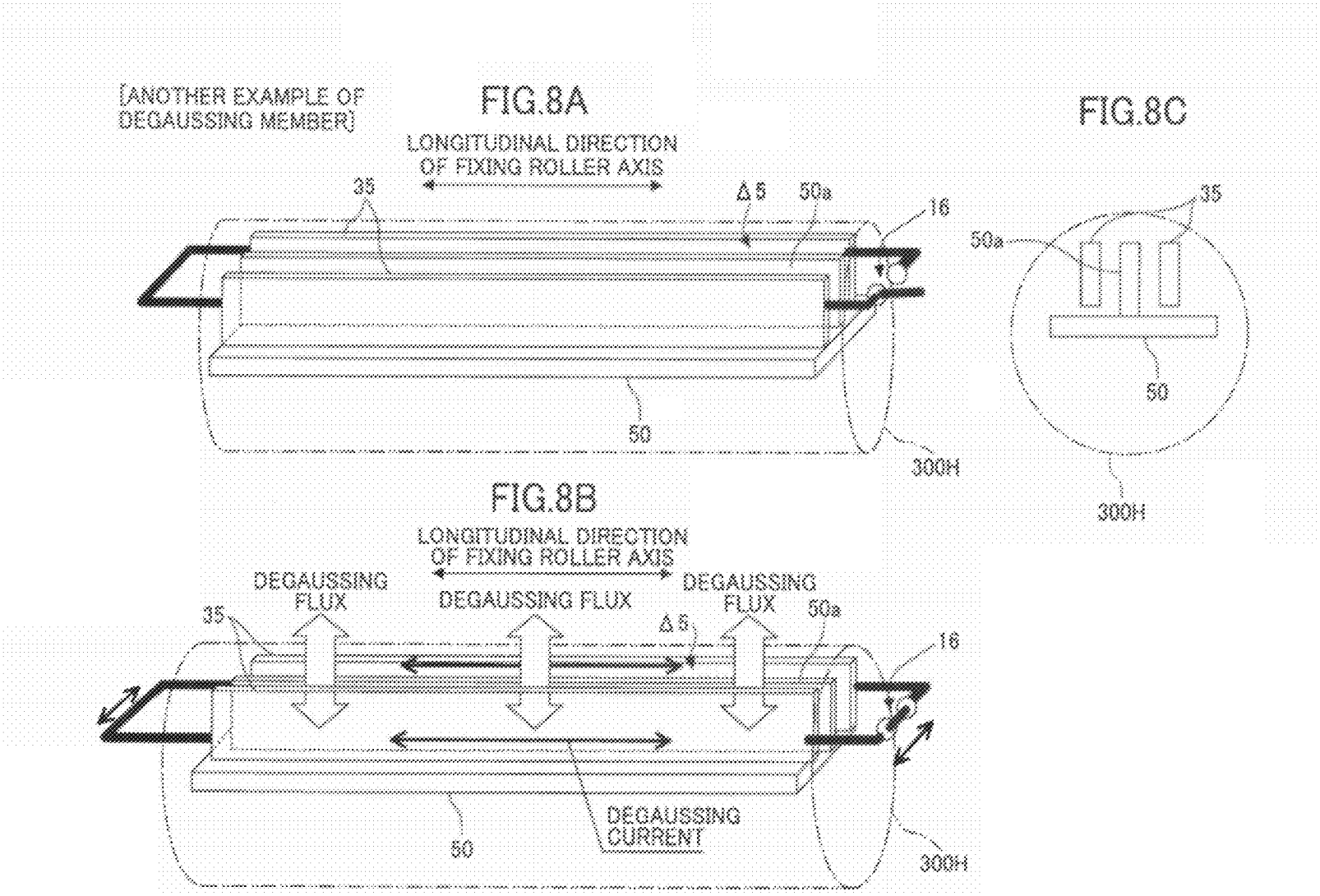
Figure 21:
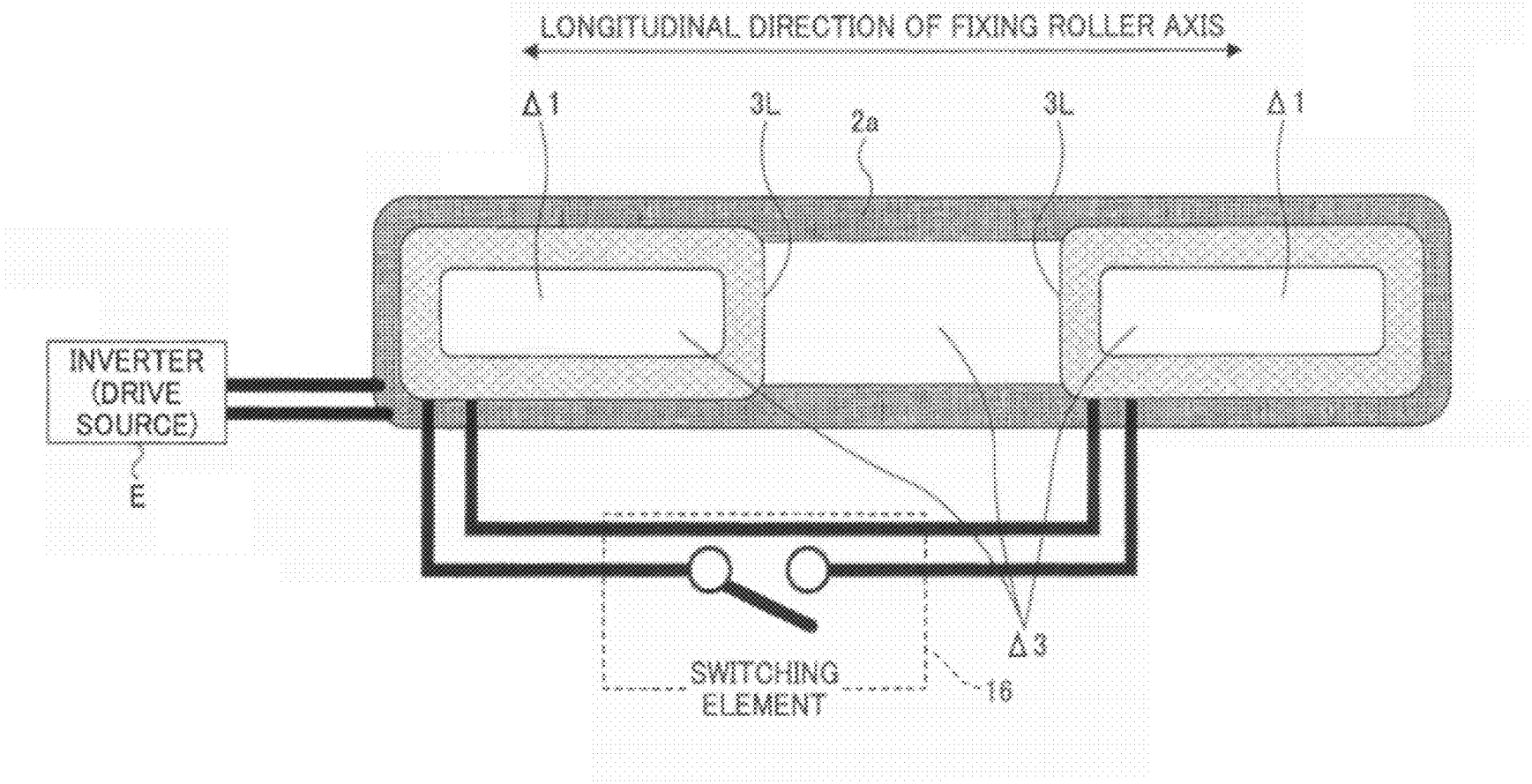
FIG. 21 is a diagram which explains a relationship among the exciting coil, the degaussing coil, the switching element, and an inverter.

As the degaussing member, while a degaussing coil 3L may be used having a coil shape using a low resistance thin wire such as a Litz wire (Cu), etc., as shown in FIGS. 2, 4, and 21, it is not limited thereto, so that two plate-shaped degaussing members 35, made of a low resistive material as shown in FIGS. 8A-8C arranged to oppose each other with the protruding member 50*a* of the magnetic path forming member 50 inbetween, are connected at both ends in the longitudinal direction, and have the switching element 16 connecting them at one of the ends to form a circuit, thus replacing with the degaussing coil 3L as shown in FIG. 2. While a plate shape is exemplified for the shape of the degaussing members 35 in the present embodiment, they are not limited thereto.

Here, the plate-shaped degaussing member 35 is arranged such that it opposes the exciting coil 2*a*, copper bodies are provided therein with an air gap inbetween, and a magnetic body (ferrite, for example; the protruding portion 50*a* of the magnetic path forming member 50) is arranged within the air gap, so that magnetic coupling of the degaussing member and the exciting coil is improved, thereby improving the degaussing performance. This is because it is desirable to ensure that the induction magnetic flux which has penetrated through the magnetic shunt layer passes through the ferrite core to the conductive body.

The mode of FIG. 8A in which the switching element 16 is turned off corresponds to FIG. 4A, and the degaussing current does not flow in the degaussing member and the heat generation is not suppressed. The mode of FIG. 8B in which the switching element 16 is turned on corresponds to FIG. 4B, and the degaussing current flows in the degaussing member and the heat generation is suppressed.

As shown in FIGS. 8A-8C, when the plate-shaped member is used as a degaussing member, it is desirable to use a high permeability, high resistance material at an inner location having a fifth air gap Δ5 to improve magnetic coupling. While a repulsive magnetic flux induced from a plate-shaped member is conceptually shown with an arrow in FIGS. 8A-8C, it is merely conceptual. FIG. 8C shows a schematic visual cross section of the degaussing member, etc.

Conditions for making it possible to deform the magnetic shunt layer are that the material is an alloy which includes iron and nickel and that the thickness is less than or equal to 150 μm, for example. When these conditions are met, it can be ensured that the magnetic shunt layer can be deformed. The magnetic shunt layer may also be arranged by forming a magnetic material layer on a deformable base layer with plating, for example. This makes it possible to ensure that the magnetic shunt layer can be deformed and to reduce tearing of the magnetic shunt layer.

Embodiment 2-4(a)

Embodiment of Heat Generation Control of Degaussing Member

Heat generation of the degaussing member that is performed by adjusting the repulsive magnetic flux may be controlled by shorting a switch (a switching element 16) of the degaussing material based on machine status information (presence/absence of warm-up; continuation time; paper passing status such as consecutive paper passing or one-off, etc.; presence/absence of an energy saving mode, etc.), so that the degaussing material is set non-functioning at the time of launch, recovery, etc., making it possible to heat to a temperature which is higher than or equal to the Curie temperature. In other words, even when it is used where the Curie temperature is 180° C., the degaussing function is set to be not operated, making it possible to fix at a temperature which is higher than or equal to the Curie temperature.

Figures 9A, 9B:
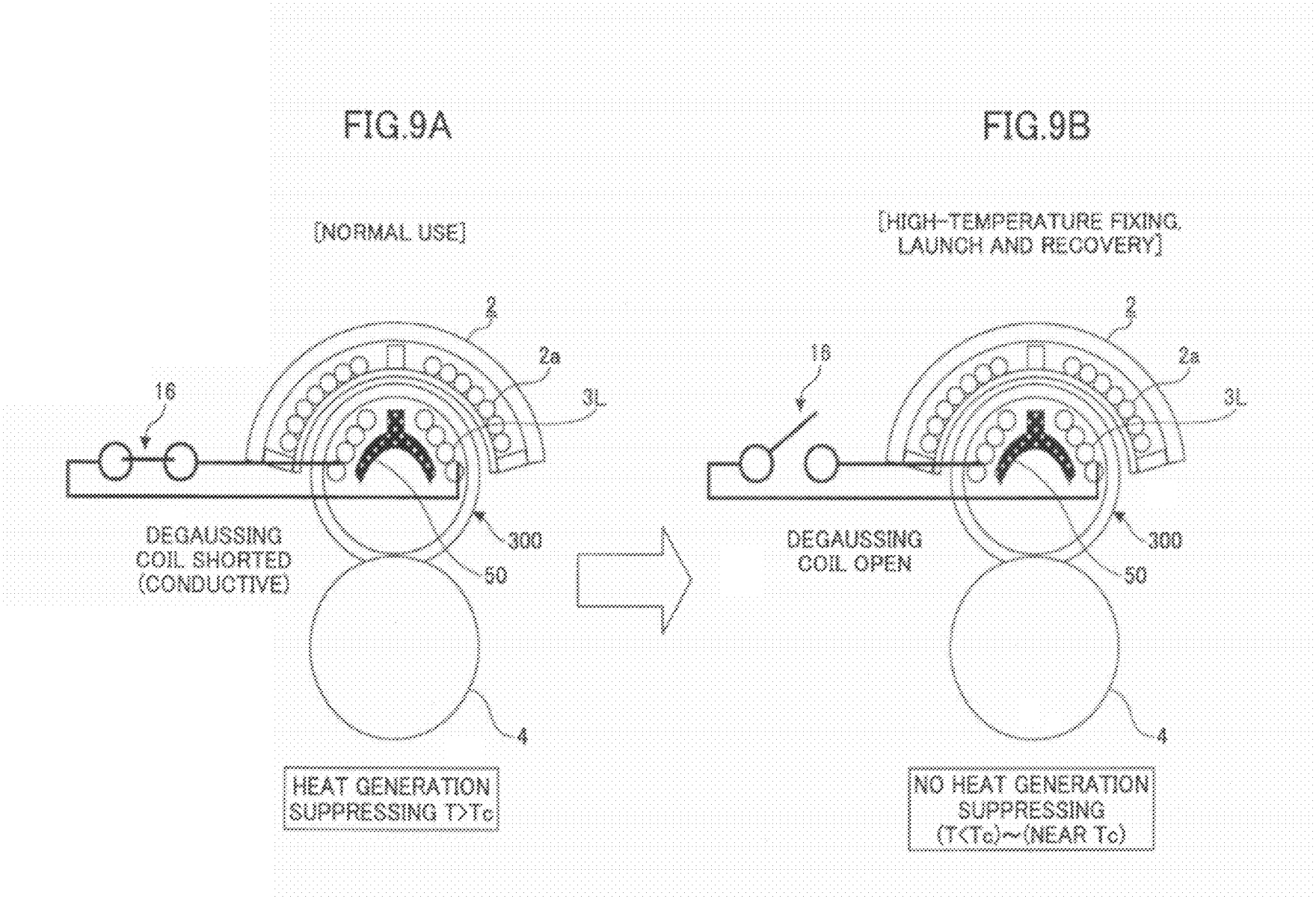
FIG. 9A shows an exemplary control when the degaussing coil is shorted.
FIG. 9B shows an exemplary control when the degaussing coil is open.

Regarding the embodiment of the fixing apparatus illustrated in FIG. 5, at the time of normal use, the switching element 16 is turned on to suppress heat generation as shown in FIG. 9A. Moreover, when there is a need for high-temperature fixing or for a launch and recovery after a pause, etc., the switching element 16 is turned off to revoke heat generation suppressing as shown in FIG. 9B.

Embodiment 3

Embodiment of Heat Generating Rotor

As a heat generating rotor used for fixing, any one of a cylindrically-shaped sleeve such as a fixing sleeve; a fixing belt, which is the sleeve shaped to be a flexible belt; and a roller shaped element which is solid or which has a large wall thickness, not a hollow shaped element which has a small wall thickness such as a fixing sleeve, may be used; and when the magnetic shunt layer is a body which is separate from the heat generating layer, the magnetic shunt layer may be or may not be fixed to the heat generating layer. In case of the latter, the belt and sleeve may be arranged to have the heat generating layer and the roller around which the belt is wound may be arranged to have the magnetic shunt layer.

Figure 10:
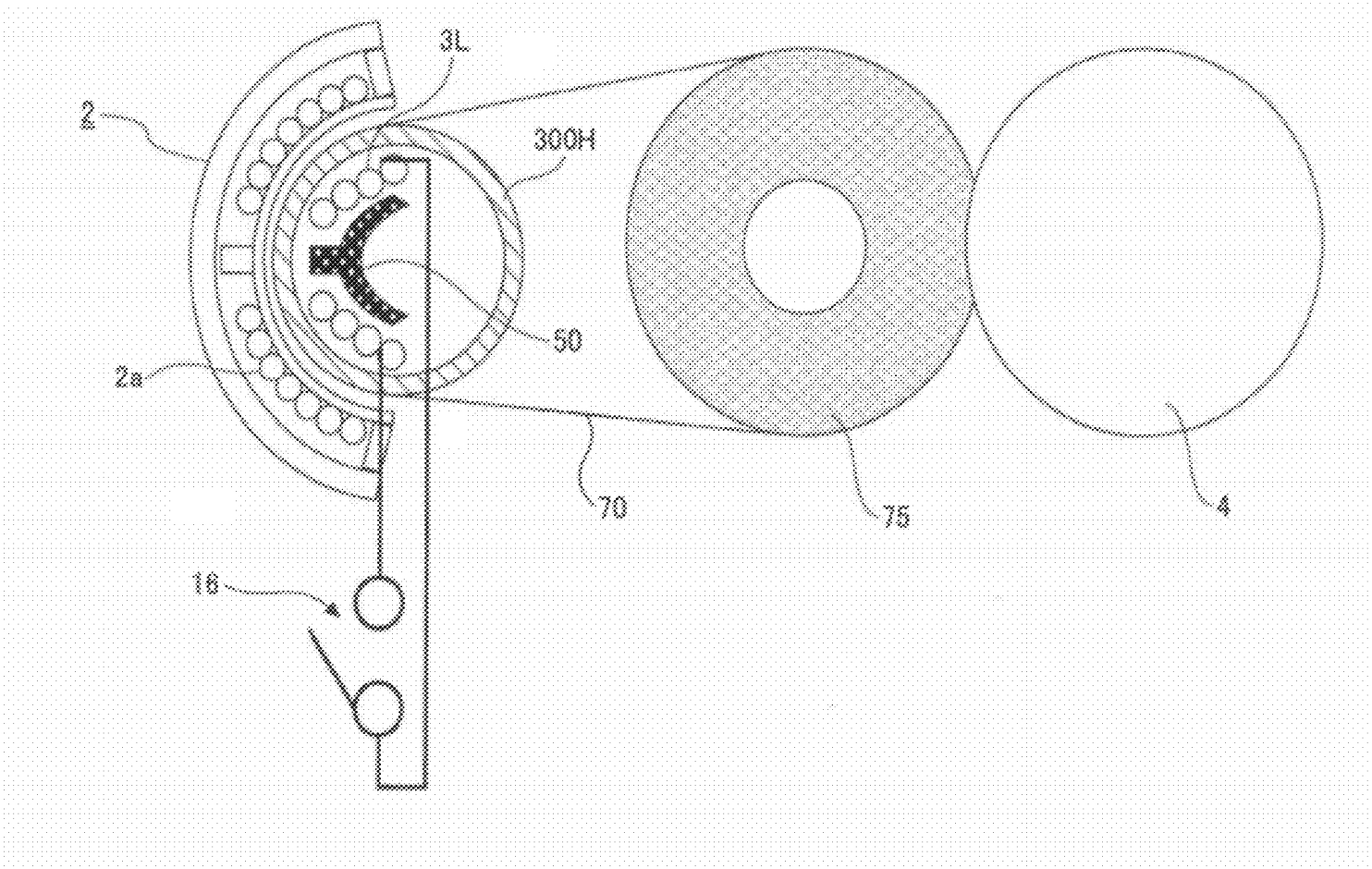
FIG. 10 is a front view of the fixing apparatus with the heating rotor set to be a fixing belt.

An exemplification is made in FIG. 10. Two modes are described using FIG. 10.

First mode: Of the feature shown in FIG. 2, elements are adopted which pertain to the magnetic flux generator 2; the fixing sleeve 300H; the exciting coil 3L; the magnetic path forming member 50; and the switching element 16. The fixing belt 70 is wound around the fixing sleeve 300H, the other end side of the fixing belt 70 is stretched by the fixing rotor 75, and the pressurizing roller 4 is pushed against the fixing rotor 75. The fixing sleeve 300H has the magnetic shunt layer and the heat generating layer. In this example, the fixing sleeve 300H, which serves as a heating rotor, supports the fixing belt 70, so that it is necessary to increase the rigidity by increasing the wall thickness.

Second mode: Of the features shown in FIG. 10 that are described in the first mode, the fixing sleeve 300H is configured as a roller only for supporting the fixing belt 70 and not as a pressurizing rotor. Moreover, the fixing belt 70 is configured as a heating rotor by including the heat generating layer and the magnetic shunt layer therein. In this embodiment as well, the fixing sleeve 300H serves as the heating rotor and supports the fixing belt 70, so that it is necessary to increase the rigidity by increasing the wall thickness, etc.

In either of these first and second modes, the sheet S is passed between the fixing rotor 75 and the pressurizing roller 4 to perform fixing.

Figure 11:
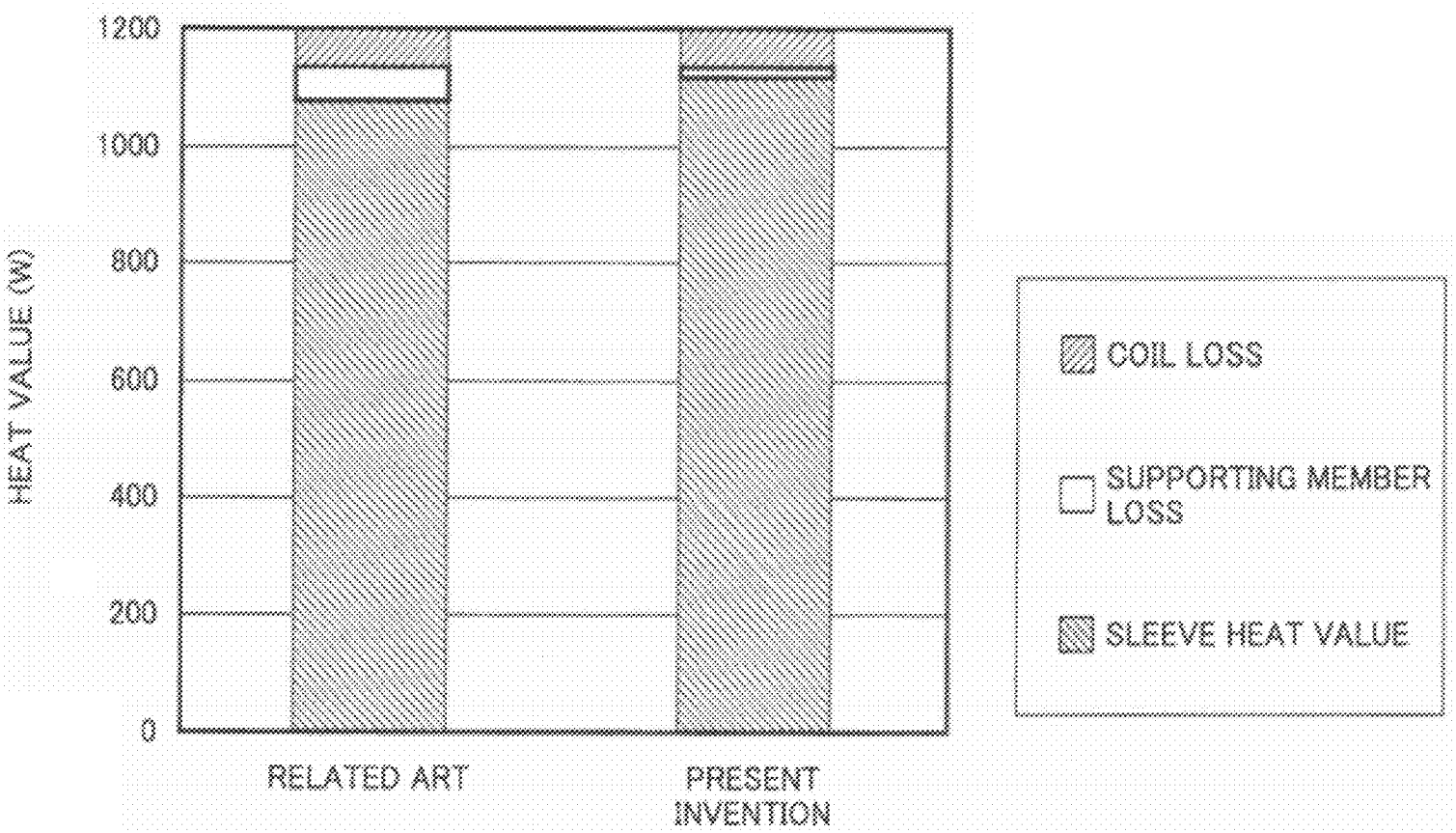
FIG. 11 is a schematic visual diagram which explains advantageous effects of embodiments of the present invention.

FIG. 11 shows a comparison of heat generation ratios of a related-art case in which an inner member loss occurs and of a case in which the loss is reduced according to embodiments of the present invention. This shows data of operational advantages in the fixing apparatus shown in FIGS. 2 and 4 and heat generation ratios at the time of injecting 1200 W. According to the present invention, a loss with respect to an internal member is reduced and a sleeve heat value (amount of heat generated) which includes the magnetic shunt member used in toner fusion is improved.

The invention claimed is:

1. A fixing apparatus, comprising:

a heat generating layer;

an exciting coil which generates a magnetic flux and which inductively heats the heat generating layer with the magnetic flux;

a magnetic shunt layer which is responsive to temperature due to heat generated in the heat generating layer;

a degaussing member which cancels the induction magnetic flux from the exciting coil with a repulsive magnetic flux, and the degaussing member is a coil; and a magnetic flux adjusting unit which acts on the degaussing member to adjust the repulsive magnetic flux, wherein a heat generating rotor is configured with at least the heat generating layer, the exciting coil is arranged outside the heat generating rotor and the degaussing member is arranged inside the heat generating rotor, and the fixing apparatus is configured to control a temperature of the heat generating layer with a self temperature control function using a Curie temperature of the magnetic shunt layer which is disposed in an opposing location of the exciting coil, wherein a magnetic path forming member which forms a magnetic path of the exciting coil is arranged on a back face side of the degaussing member that is a reverse side of the magnetic shunt layer with the degaussing member therebetween.

2. The fixing apparatus as claimed in claim 1, wherein the degaussing member is made of a conductive metal material, and the magnetic flux adjusting unit which adjusts the repulsive magnetic flux adjusts the repulsive magnetic flux by switching between conducting and non-conducting by operating a switch.

3. The fixing apparatus as claimed in claim 1, wherein the degaussing member includes a conductive member, is formed such that the degaussing member is arranged to oppose the exciting coil and oppose a conductive wire of the exciting coil, and includes a first air gap at a location which opposes a space inside the exciting coil.

4. The fixing apparatus as claimed in claim 3, wherein the conductive member which makes up the degaussing member is supported on the magnetic path forming member and at least a part of the magnetic path forming member is arranged in the first air gap.

5. The fixing apparatus as claimed in claim 1, wherein the heat generating rotor forms a cylindrical body, the magnetic shunt layer is configured as a part of the cylindrical body, the magnetic shunt layer and the heat generating layer are integrally formed, and the cylindrical body and the degaussing member are arranged via a second air gap.

6. The fixing apparatus as claimed in claim 5, wherein the magnetic shunt layer is formed such that the magnetic shunt layer follows an inner face shape of the cylindrical body which includes the heat generating layer, and the magnetic shunt layer and the degaussing member are arranged with an air gap therebetween.

7. The fixing apparatus as claimed in claim 1, wherein the repulsive magnetic flux is adjusted by opening and closing of a switch connected to both ends of a winding of the coil.

8. The fixing apparatus as claimed in claim 7, wherein the repulsive magnetic flux is adjusted based on information on a fixing temperature.

9. The fixing apparatus as claimed in claim 1, wherein the heat generating rotor is one of a fixing sleeve, a fixing roller, and a fixing belt, and the fixing apparatus includes a pressurizing rotor which presses against the heat generating rotor, the fixing apparatus being configured to fix an image on a sheet shaped recording medium which passes between the heat generating rotor and the pressurizing rotor.

10. The fixing apparatus as claimed in claim 9, wherein the heat generating rotor is a fixing belt or a heating roller which heats the fixing belt, the fixing apparatus including a fixing rotor which stretches the fixing belt wound around the heat generating rotor.

11. An image forming apparatus, comprising the fixing apparatus as claimed in claim 1.

* * * * *